US008033532B2

(12) United States Patent
Yabu

(10) Patent No.: US 8,033,532 B2
(45) Date of Patent: Oct. 11, 2011

(54) HUMIDIFIER

(75) Inventor: Tomohiro Yabu, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 1048 days.

(21) Appl. No.: 11/887,247

(22) PCT Filed: Mar. 27, 2006

(86) PCT No.: PCT/JP2006/306161

§ 371 (c)(1),
(2), (4) Date: Sep. 27, 2007

(87) PCT Pub. No.: WO2006/106630

PCT Pub. Date: Oct. 12, 2006

(65) Prior Publication Data

US 2009/0267243 A1 Oct. 29, 2009

(30) Foreign Application Priority Data

Mar. 31, 2005 (JP) ..... 2005-103777

(51) Int. Cl.
*B01F 3/04* (2006.01)

(52) U.S. Cl. ..... 261/152; 261/157; 261/160; 261/58

(58) Field of Classification Search ..... 261/49, 261/58, 67, 131, 152, 153, 154, 155, 156, 261/157, 160
See application file for complete search history.

(56) References Cited

U.S. PATENT DOCUMENTS 4,574,062 A * 3/1986 Weitman ..... 261/147
5,088,295 A * 2/1992 Shapiro-Baruch ..... 62/196.4
5,453,223 A * 9/1995 Maisotsenko ..... 261/153
5,510,087 A * 4/1996 Johnson et al. ..... 422/173
6,446,942 B1 * 9/2002 Tsai ..... 261/156
7,770,405 B1 * 8/2010 Dillon ..... 62/176.5

FOREIGN PATENT DOCUMENTS

JP 4-132311 U 12/1992
JP 6-58642 A 3/1994
JP 7-265649 A 10/1995
JP 2003-251354 A 9/2003
JP 2004-60954 A 2/2004

* cited by examiner

*Primary Examiner* — Charles Bushey
(74) *Attorney, Agent, or Firm* — Birch, Stewart, Kolasch & Birch, LLP

(57) ABSTRACT

A humidifier 10 has a water circuit 20 that switches the flow of water between a first flow state, in which hot water introduced from a first inlet 21 flows through a first heat exchanger 32 and flows to a first outlet 22 and in which cold water introduced from a second inlet 23 flows through a second heat exchanger 42 and flows to a second outlet 24, and a second flow state, in which the hot water introduced from the first inlet 21 flows through the second heat exchanger 42 and flows to the first outlet 22 and in which the cold water introduced from the second inlet 23 flows through the first heat exchanger 32 and flows to the second outlet 24. The water circuit 20 has a bypass passage 36 for connecting the inlets 21, 23 to the outlets 22, 24 respectively at the time of switching the flow of water. With this, even if the respective three-way valves 31, 33, . . . cause a faulty operation, the cold water and the hot water surely flow through the bypass passage 36 and flow to the respective outlets 22, 24.

11 Claims, 21 Drawing Sheets

HUMIDIFIER

BACKGROUND OF THE INVENTION

1. Technical Field

The present invention relates to a humidifier and, in particular, to protective measures of piping and the like of a humidifier having a water circuit and performing a batch operation.

2. Related Art

There has been known a humidifier that adjusts the humidity of air by the use of an adsorbent and a refrigeration cycle (for example, see patent document 1).

A humidifier disclosed in the patent document 1 has two adsorbing devices each having an adsorbent and a refrigerant circuit for performing a refrigeration cycle. This humidifier performs a first operation that dehumidifies first air by a first adsorbing device and that reproduces a second adsorbing device by second air heated by a condenser of the refrigerant circuit and a second operation that humidifies the first air by the second adsorbing device and that reproduces the first adsorbing device by the second air heated by the condenser. These two operations are alternately performed, whereby the dehumidified first air or the humidified second air is supplied into the room.

On the other hand, it can be thought to use an adsorption heat exchanger in which the adsorbing device and a heat exchanger are combined in one unit having the adsorbent supported thereon. In this case, the adsorption heat exchanger is constructed of a so-called fin-and-tube type heat exchanger having many plate-shaped fins and a copper pipe passing through the fins. The adsorbent is supported on the surfaces of the fins and the copper pipe. This heat exchanger dehumidifies and humidifies air flowing therethrough by the adsorbent and heats and cools the adsorbent by refrigerant flowing through the copper pipe.

Further, a humidifier can be thought that uses a water circuit, in which cold water and hot water flow, in place of the refrigerant circuit. In other words, the cold water and the hot water are alternately flowed through the adsorption heat exchanger to cool and heat the adsorbent.

Patent document 1: Japanese Unexamined Patent Publication No. 2004-60954

DISCLOSURE OF THE INVENTION

Problems to be Solved by the Invention

However, a conventional humidifier using the foregoing water circuit presents a problem that there is a possibility that the flow of water is intercepted at the time of switching the flow of water. In other words, the flow of water is switched by the use of a three-way valve or a four-way valve, and when these the three-way valve or the like is not normally switched because of a faulty operation or the like, the flow of water is intercepted. This develops high pressure in the piping and the heat exchanger because water is non-compressible fluid. In the worst case, there is presented a problem that these parts might be ruptured.

The present invention has been made in view of this problem. The object of the present invention is to prevent high pressure from being applied to piping and the like of a humidifier when the flow of water is intercepted by the faulty operation of a switching valve at the time of switching the flow of water, the humidifier switching the flow of water to adsorb and desorb moisture by an adsorbent in an adsorption heat exchanger.

Means to Solve the Invention

A first invention is predicated on a humidifier including a water circuit 20 which has a first heat exchanger 32 and a second heat exchanger 42 connected thereto and through which waters of cold water and hot water flow, the first heat exchanger 32 and the second heat exchanger 42 each having an adsorbent and adsorbing moisture in air and desorbing the moisture to discharge the moisture into the air, the water circuit 20 switching flow of the water between a first flow state, in which the hot water introduced from a first inlet 21 flows through the first heat exchanger 32 and flows to a first outlet 22 and in which the cold water introduced from a second inlet 23 flows through the second heat exchanger 42 and flows to a second outlet 24, and a second flow state, in which the hot water introduced from the first inlet 21 flows through the second heat exchanger 42 and flows to the first outlet 22 and in which the cold water introduced from the second inlet 23 flows through the first heat exchanger 32 and flows to the second outlet 24, and adsorbing and desorbing the moisture alternately by the first heat exchanger 32 and the second heat exchanger 42. The water circuit 20 has bypass passages for connecting the respective inlets 21, 23 to the respective outlets 22, 24 at the time of switching the flow of the water.

In the foregoing invention, in the first heat exchanger 32 or the second heat exchanger 42 through which the cold water flows, the moisture in passing air is adsorbed by the adsorbent, whereby the air is dehumidified. On the other hand, in the second heat exchanger 42 or the first heat exchanger 32 through which the hot water flows, moisture desorbed from the adsorbent is discharged into the passing air, whereby the air is humidified. Here, the water circuit 20 switches the flow of the water in such a way that the cold water and the hot water flow alternately through the first heat exchanger 32 and the second heat exchanger 42, whereby the air is continuously dehumidified and humidified.

The switching of the flow of the water in the water circuit 20 is performed by switching a passage switching valve such as a three-way valve and a four-way valve. Here, when the passage switching valve is not at all switched or is held in an intermediate opening state because of a faulty operation or the like, there is a possibility that the flow of the water will be intercepted. Then, because water is non-compressible fluid, high pressure will be applied to the piping and the heat exchangers 32, 42.

However, the present invention has the bypass passages for connecting the respective inlets 21, 23 to the respective outlets 22, 24 at the time of switching the passage switching valve, in other words, at the time of switching the flow of the water. Thus, if the passage switching valve causes a faulty operation or the like, the water introduced from the respective inlets 21, 23 can be surely flowed to the respective outlets 22, 24. Hence, the flow of the water is not intercepted, which can prevent high pressure from being applied to the piping and the like.

A second invention is predicated on a humidifier including a water circuit 20 which has a first heat exchanger 32 and a second heat exchanger 42 connected thereto and through which either water of cold water and hot water flows, the first heat exchanger 32 and the second heat exchanger 42 each having an adsorbent and adsorbing moisture in air and desorbing the moisture to discharge the moisture into the air, the water circuit 20 switching flow of the water between a first flow state, in which the water introduced from an inlet 21 flows through the first heat exchanger 32 and flows to an outlet 22, and a second flow state, in which the water introduced from the inlet 21 flows through the second heat exchanger 42 and flows to the outlet 22, and adsorbing and desorbing the moisture alternately by the first heat exchanger 32 and the second heat exchanger 42. The water circuit 20 has a bypass passage for connecting the inlet 21 to the outlet 22 at the time of switching the flow of the water.

In the foregoing invention, for example, when only the cold water flows through the water circuit 20, the moisture in passing air is adsorbed by the adsorbent in the first heat exchanger 32 or the second heat exchanger 42 in which the cold water flows, whereby the air is dehumidified. On the other hand, the moisture naturally desorbed from the adsorbent is discharged into the passing air in the second heat exchanger 42 or the first heat exchanger 32 in which the cold water does not flow, whereby the air is humidified.

Further, when only the hot water flows through the water circuit 20, the moisture desorbed from the adsorbent is discharged into the passing air in the first heat exchanger 32 or the second heat exchanger 42 in which the hot water flows, whereby the air is humidified. On the other hand, the moisture in the passing air is adsorbed by the adsorbent in the second heat exchanger 42 or the first heat exchanger 32 in which the hot water does not flow, whereby the air is dehumidified. The water circuit 20 has the flow of the water switched by the passage switching valve in such a way that the cold water or the hot water flows alternately through the first heat exchanger 32 or the second heat exchanger 42.

Here, even if the passage switching valve causes a faulty operation or the like, just as with the first invention described above, the water introduced from the respective inlets 21, 23 surely flows to the respective outlets 22, 24. Hence, the flow of the water is not intercepted, which can prevent high pressure from being applied to the piping and the like. A third invention is such that in the first or second invention, the bypass passage has a bypass shutoff valve 37 and is connected to either of the upstream side and the downstream side of the first heat exchanger 32 and to either of the upstream side and the downstream side of the second heat exchanger 42.

In the foregoing invention, for example, when the water flows through a route passing through the first heat exchanger 32 at the time of switching the flow of the water, even if the passage switching valve causes a faulty operation to intercept the route, by opening the bypass shutoff valve 37, the water flows to a route passing through the second heat exchanger 42 via the bypass passage and then flows to the outlets 22, 24 without being intercepted. Further, also when the route passing through the second heat exchanger 42 is intercepted, in the same way, the water flows to the route passing through the first heat exchanger 32 via the bypass passage and is discharged from the outlets 22, 24. Hence, the interception of the flow of the water can be prevented.

A fourth invention is such that in the first invention, the water circuit 20 has hot-water inlet side switching means 31, hot-water outlet side switching means 33, cold-water inlet side switching means 41, and cold-water outlet side switching means 43, the switching means 31, 33, 41, and 43 being used for switching the flow of the water between the first flow state and the second flow state. The foregoing bypass passage has at least either of a hot-water bypass passage and a cold-water bypass passage, the hot-water bypass passage having a bypass shutoff valve 37 and being connected to the upstream side of the hot-water inlet side switching means 31 and to the downstream side of the hot-water outlet side switching means 33, the cold-water bypass passage having a bypass shutoff valve 37 and being connected to the upstream side of the cold-water inlet side switching means 41 and to the downstream side of the cold-water outlet side switching means 43.

In the foregoing invention, even when both of the hot-water inlet side switching means 31 and the hot-water outlet side switching means 33 are brought to an intermediate opening state because of a faulty operation, by opening the hot-water bypass shutoff valve 37 at the time switching the flow of the water, the hot water introduced from the first inlet 21 surely flows through the hot-water bypass passage and flows to the first outlet 22. Further, even when both of the cold-water inlet side switching means 41 and the cold-water outlet side switching means 43 are brought to an intermediate opening state, by opening the cold-water bypass shutoff valve 37 at the time switching the flow of the water, the cold water introduced from the second inlet 23 surely flows through the cold-water bypass passage and flows to the second outlet 24. Hence, the interception of the flow of at least either of the cold water and the hot water can be avoided, which can prevent high pressure from being applied to the piping and the like.

A fifth invention is such that in the first invention, the water circuit 20 has hot-water inlet side switching means 31, hot-water outlet side switching means 33, cold-water inlet side switching means 41, and cold-water outlet side switching means 43, the switching means 31, 33, 41, and 43 being used for switching the flow of the water between the first flow state and the second flow state. At the time of switching the flow of the water, the respective outlet side switching means 33, 43 are switched and then the respective inlet side switching means 31, 41 are switched.

In the foregoing invention, the respective outlet side switching means 33, 43 are switched earlier at the time of switching the flow of the water. Thus, as compared with a case where the respective inlet side switching means 31, 41 are switched earlier, the cold water and the hot water can be continuously flowed through the specified first heat exchanger 32 or second heat exchanger 42 until switching the flow of the water is finished. With this, it is possible to prevent a decrease in the capacity of dehumidifying and humidifying air at the time of switching the flow of the water.

A sixth invention is such that in the fifth invention, when a humidifying operation is performed, at the time of switching the flow of the water, the cold-water outlet side switching means 43 is switched and then the hot-water outlet side switching means 33 is switched.

In the foregoing invention, when the humidifying operation is performed, air humidified by the first heat exchanger 32 or the second heat exchanger 42 through which the hot water flows is supplied to a use side. Here, the cold-water outlet side switching means 43 is switched earlier at the time of switching the flow of the water, so the flow of the cold water is intercepted until the hot-water outlet side switching means 33 is switched. In other words, at the time of switching the flow of the water, the hot water flows through the first heat exchanger 32 or the second heat exchanger 42 for a longer time than the cold water. Thus, it is possible to prevent a decrease in the capacity of humidifying air.

A seventh invention is such that in the fifth invention, when a dehumidifying operation is performed, at the time of switching the flow of the water, the hot-water outlet side switching means 33 is switched and then the cold-water outlet side switching means 43 is switched.

In the foregoing invention, when the dehumidifying operation is performed, air dehumidified by the first heat exchanger 32 or the second heat exchanger 42 through which the cold water flows is supplied to the use side. Here, the hot-water outlet side switching means 33 is switched earlier at the time of switching the flow of the water, so the flow of the hot water is intercepted until the cold-water outlet side switching means 43 is switched. In other words, at the time of switching the flow of the water, the cold water flows through the first heat exchanger 32 or the second heat exchanger 42 for a longer time than the hot water. Thus, it is possible to prevent a decrease in the capacity of humidifying air.

An eighth invention is such that in the second invention, the water circuit 20 has inlet side switching means 31 and outlet side switching means 33 for switching the flow of the water between the first flow state and the second flow state. Further, the bypass passage has a bypass shutoff valve 37 and is connected to the upstream side of the inlet side switching means 31 and to the downstream side of the outlet side switching means 33.

In the foregoing invention, even when both of the inlet side switching means 31 and the outlet side switching means 33 are brought to an intermediate opening state because of a faulty operation, by opening the bypass shutoff valve 37 at the time of switching the flow of the water, the cold water or the hot water introduced from the inlet 21 surely flows through the bypass passage to the outlet 22. Thus, it is possible to avoid the interception of the flow of water and hence to prevent high pressure from being applied to the piping and the like.

A ninth invention is such that in the second claim, the water circuit 20 has inlet side switching means 31 and outlet side switching means 33 for switching the flow of the water between the first flow state and the second flow state. Further, at the time of switching the flow of the water, the outlet side switching means 33 is switched and then the inlet side switching means 31 is switched.

In the foregoing invention, at the time of switching the flow of the water, the outlet side switching means 33 is switched earlier, so as compared with a case where the inlet side switching means 31 is switched earlier, the cold water or the hot water can be flowed longer, even if only a little, through the specified first heat exchanger 32 or second heat exchanger 42 until switching the flow of the water is finished. With this, it is possible to prevent a decrease in the capacity of dehumidifying and humidifying air at the time of switching the flow of the water.

A tenth invention is predicated on a humidifier including a water circuit 20 which has a first heat exchanger 32 and a second heat exchanger 42 connected thereto and through which waters of cold water and hot water flow, the first heat exchanger 32 and the second heat exchanger 42 each having an adsorbent and adsorbing moisture in air and desorbing the moisture to discharge the moisture into the air, the water circuit 20 including switching means 31, 33, 41, 43 for switching the flow of the water between a first flow state, in which the hot water introduced from a first inlet 21 flows through the first heat exchanger 32 and flows to a first outlet 22 and in which the cold water introduced from a second inlet 23 flows through the second heat exchanger 42 and flows to a second outlet 24, and a second flow state, in which the hot water introduced from the first inlet 21 flows through the second heat exchanger 42 and flows to the first outlet 22 and in which the cold water introduced from the second inlet 23 flows through the first heat exchanger 32 and flows to the second outlet 24, and adsorbing and desorbing the moisture alternately by the first heat exchanger 32 and the second heat exchanger 42. Further, the water circuit 20 has buffer tanks 39, 49 of the cold water and the hot water disposed upstream of the outlet side switching means 33, 43.

In the foregoing invention, just as with the first invention, the switching of the flow of the water is performed by switching a passage switching valve such as a three-way valve and a four-way valve, and if the passage switching valve is not switched because of a faulty operation or the like, the flow of the water is intercepted to bring about a state in which high pressure is applied in the piping.

However, in this invention, the buffer tanks 39, 49 are disposed upstream of the outlet side switching means 33, 43, so the hot water and the cold water introduced from the respective inlets 21, 23 are stored in the buffer tanks 39, 49 as they are. In other words, high pressure developed in the piping and the like is absorbed by the buffer tanks 39, 49. Thus, this can prevent high pressure from being applied to the piping and the heat exchangers 32, 42.

An eleventh invention is predicted on a humidifier including a water circuit 20 which has a first heat exchanger 32 and a second heat exchanger 42 connected thereto and through which either water of cold water and hot water flows, the first heat exchanger 32 and the second heat exchanger 42 each having an adsorbent and adsorbing moisture in air and desorbing the moisture to discharge the moisture into the air, the water circuit 20 including switching means 31, 33 for switching flow of the water between a first flow state, in which the water introduced from an inlet 21 flows through the first heat exchanger 32 and flows to an outlet 22, and a second flow state, in which the water introduced from the inlet 21 flows through the second heat exchanger 42 and flows to the outlet 22, and adsorbing and desorbing the moisture alternately by the first heat exchanger 32 and the second heat exchanger 42. Further, the water circuit 20 has buffer tanks 39, 49 of the water disposed upstream of the outlet side switching means 33.

In the foregoing invention, just as with the second invention, the switching of the flow of the water is performed by switching a passage switching valve such as a three-way valve and a four-way valve, and if the passage switching valve is not switched because of a faulty operation or the like, the flow of the water is intercepted to bring about a state in which high pressure is applied in the piping.

However, in this invention, the buffer tanks 39, 49 of the water are disposed upstream of the outlet side switching means 33, so the hot water or the cold water introduced from the respective inlets 21, 23 is stored in the buffer tanks 39, 49 as it is. In other words, high pressure developed in the piping and the like is absorbed by the buffer tanks 39, 49. Thus, this can prevent high pressure from being applied to the piping and the heat exchangers 32, 42.

A twelfth invention is such that in the claim 1, the water circuit 20 switches the flow of the water and the flow of air in such a way that in the first flow state, first air is dehumidified by the second heat exchanger 42 and second air is humidified by the first heat exchanger 32 and in such a way that in the second flow state, the first air is dehumidified by the first heat exchanger 32 and the second air is humidified by the second heat exchanger 42. Further, the flow of air is switched after a specified time passes from when the flow of at least either of the cold water and the hot water is switched.

In the foregoing invention, in the first heat exchanger 32 or the second heat exchanger 42 through which the cold water flows, the moisture in the first air is adsorbed by the adsorbent and the adsorbent and the first air are cooled by the cold water. On the other hand, in the second heat exchanger 42 or the first heat exchanger 32 through which the hot water flows, the moisture desorbed from the adsorbent is discharged into the second air and the adsorbent and the second air are heated by the hot water. When the cooling dehumidifying operation is performed, the first air is supplied into the room, whereas when the heating humidifying operation is performed, the second air is supplied into the room.

Here, when the cooling dehumidifying operation is performed, the flow of air is switched after a specified time passes from when the flow of only the cold water is switched or from when the flows of the cold water and the hot water are switched. With this, by the time when the flow of air is switched, the heat exchangers 32, 43 heated by the hot water are previously cooled by the cold water. Thus, it does not happen that the first air passing through the heat exchangers 32, 42 is heated after the flow of air is switched. Hence, it does not happen that hot air is supplied into the room.

On the other hand, when the heating humidifying operation is performed, the flow of air is switched after a specified time passes from when the flow of only the hot water is switched or from when the flows of the hot water and the cold water are switched. With this, by the time when the flow of air is switched, the heat exchangers 32, 43 cooled by the cold water are previously heated by the hot water. Thus, it does not happen that the second air passing through the heat exchangers 32, 42 is cooled after the flow of air is switched. Hence, it does not happen that cold air is supplied into the room.

A thirteenth invention is such that in the second invention, the water circuit 20 switches the flow of the cold water and flow of air in such a way that in the first flow state, first air is dehumidified by the first heat exchanger 32, through which the cold water flows, and second air is humidified by the second heat exchanger 42 and in such a way that in the second flow state, the first air is dehumidified by the second heat exchanger 42, through which the cold water flows, and the second air is humidified by the first heat exchanger 32. Further, the flow of air is switched after a specified time passes from when the flow of the cold water is switched.

In the foregoing invention, only the cold water flows in the water circuit 20. In the first heat exchanger 32 or the second heat exchanger 42 in which the cold water flows, the moisture in the first air is adsorbed by the adsorbent and the adsorbent and the first air are cooled by the cold water. On the other hand, in the second heat exchanger 42 or the first heat exchanger 32 in which the cold water does not flow, the moisture desorbed from the adsorbent is discharged into the second air. When the cooling dehumidifying operation is performed, the first air is supplied into the room and when the heating humidifying operation is performed, the second air is supplied into the room.

Here, when the cooling dehumidifying operation is performed, the flow of air is switched after a specified time passes from when the flow of the cold water is switched. With this, by the time when the flow of air is switched, the heat exchangers 32, 42 are previously cooled by the cold water. Thus, it does not happen that the first air passing through the heat exchanger 32, 42 after the flow of air is switched is heated. With this, it does not happen that warm air is supplied into the room.

A fourteenth invention is such that in the second invention, the water circuit 20 switches the flow of the hot water and the flow of air in such a way that in the first flow state, second air is humidified by the first heat exchanger 32, through which the hot water flows, and first air is humidified by the second heat exchanger 42 and in such a way that in the second flow state, the second air is humidified by the second heat exchanger 42, through which the hot water flows, and the first air is dehumidify by the first heat exchanger 32. Further, the flow of air is switched after a specified time passes from when flow of the hot water is switched.

In the foregoing invention, only the hot water flows in the water circuit 20. In the first heat exchanger 32 or the second heat exchanger 42 in which the hot water flows, the moisture in the first air is adsorbed by the adsorbent. On the other hand, in the second heat exchanger 42 or the first heat exchanger 32 in which the hot water does not flow, the moisture desorbed from the adsorbent is discharged into the second air and the adsorbent and the second air are heated by the hot water. When the cooling dehumidifying operation is performed, the first air is supplied into the room and when the heating humidifying operation is performed, the second air is supplied into the room.

Here, when the heating humidifying operation is performed, the flow of air is switched after the specified time passes from when the flow of the hot water is switched. With this, by the time when the flow of air is switched, the heat exchangers 32, 42 are previously heated by the hot water. Thus, it does not happen that the second air passing through the heat exchanger 32, 42 after the flow of air is switched is cooled. With this, it does not happen that cold air is supplied into the room.

A fifteenth invention is such that in the twelfth invention, when a dehumidifying operation for supplying the dehumidified first air to a use side is performed, the water circuit 20 is switched to an intermediate state in which the flow of the hot water to the first heat exchanger 32 and the second heat exchanger 42 is intercepted for a specified time that passes from when the flow of the cold water is switched until the flow of air is switched.

In the foregoing invention, in the intermediate state, the hot water does not flow through the heat exchangers 32, 42 in which the first air flows, so it does not happen that the first air is heated. Thus, also in the intermediate state, warm air is not supplied into the room.

A sixteenth invention is such that in the twelfth invention, when a humidifying operation for supplying the humidified second air to a use side is performed, the water circuit 20 is switched to an intermediate state in which the flow of the cold water to the first heat exchanger 32 and the second heat exchanger 42 is intercepted for a specified time that passes from when the flow of the hot water is switched until the flow of air is switched.

In the foregoing invention, in the intermediate state, the cold water does not flow through the heat exchangers 32, 42 in which the second air flows, so it does not happen that the second air is cooled. Thus, also in the intermediate state, cold air is not supplied into the room.

A seventeenth invention is such that in the fifteenth invention, the water circuit 20 has a bypass passage through which the hot water flows so as to bypass the first heat exchanger 32 and the second heat exchanger 42 at the time of the intermediate state.

In the foregoing invention, in the intermediate state, the hot water flows through the bypass passage and bypasses the heat exchangers 32, 42, so the flow of the hot water to the heat exchangers 32, 42 can be surely intercepted. Thus, it is possible to surely prevent warm air from being supplied into the room in the intermediate state.

An eighteenth invention is the humidifier characterized in that in the sixteenth invention, the water circuit 20 has a bypass passage through which the cold water flows to bypass the first heat exchanger 32 and the second heat exchanger 42 at the time of the intermediate state.

In the foregoing invention, in the intermediate state, the cold water flows through the bypass passage and bypasses the heat exchangers 32, 42, so the flow of the cold water to the heat exchangers 32, 42 can be surely intercepted. Thus, it is possible to surely prevent cold air from being supplied into the room in the intermediate state.

Effect of the Invention

Therefore, according to the present invention, the water circuit 20 is provided with the bypass passage that connects the respective inlets 21, 23 to the respective outlets 22, 24 at the time of switching the flow of water, so even if the passage switching valve causes a faulty operation, cold water and hot water can be surely discharged to the respective outlets 22, 24 via the bypass passage. Therefore, it is possible to prevent the interception of the flow of water, so it is possible to prevent high pressure from being applied to the piping and the heat exchangers 32, 42. As a result, it is possible to protect the humidifier.

Further, according to the second invention, even when the passage switching valve causes a faulty operation in the water circuit 20 in which only cold water or only hot water flows, the cold water or the hot water can be surely discharged to the outlet 22 via the bypass passage. Therefore, it is possible to prevent high pressure from being applied to the piping and the heat exchangers 32, 42 and hence to protect the humidifier.

Still further, according to the third invention, the water circuit 20 is provided with the bypass passage that is connected to either of the upstream side and the downstream side of the first heat exchanger 32 and to either of the upstream side and the downstream side of the second heat exchanger 42. Thus, for example, even if the flow of water is intercepted in a route passing through the first heat exchanger 32, it is possible to flow the water having flowed in the route to a route passing through the second heat exchanger 42 and to discharge the water from the outlets 22, 24 without intercepting the flow of the water. With this, it is possible to prevent high pressure from being applied to the piping and the like.

Still further, according to the fourth invention, the hot-water bypass passage is connected to the upstream side of the hot-water inlet side switching means 31 and to the downstream side of the hot-water outlet side switching means 33, and the cold-water bypass passage is connected to the upstream side of the cold-water inlet side switching means 41 and to the downstream side of the cold-water outlet side switching means 43. Thus, even when both of the respective inlet side switching means 31, 41 and the respective outlet side switching means 33, 43 are brought into the intermediate opening state, the cold water or the hot water can be surely flowed to the respective outlets 22, 24 via the respective bypass passages. Therefore, it is possible to avoid the flow of the cold water and the flow of the hot water from being intercepted and hence to protect the piping and the like from high hydraulic pressure.

Still further, according to the fifth invention, at the time of switching the flow of water, the hot-water outlet side switching means 33 and the cold-water outlet side switching means 43 are switched and then the hot-water inlet side switching means 31 and the cold-water inlet side switching means 41 are switched. Thus, during the time that passes when the flow of water is switched, the cold water and the hot water can be flowed longer, even if only a little, through the specified first heat exchanger 32 and second heat exchanger 42. Therefore, it is possible to prevent a decrease in the capacity of dehumidifying and humidifying air at the time of switching the flow of water.

Still further, according to the sixth or seventh invention, when the humidifying operation is performed, the cold-water outlet side switching means 43 is switched and then the hot-water outlet side switching means 33 is switched, whereas when the dehumidifying operation is performed, the hot-water outlet side switching means 33 is switched and then the cold-water outlet side switching means 43 is switched. Thus, at the time of switching the flow of water, the hot water or the cold water can be flowed longer, even if only a little, to the heat exchangers 32, 42 that supply the humidified air or the dehumidified air to a use side. Therefore, it is possible to prevent a decrease in the capacity of dehumidifying and humidifying air at the time of switching the flow of water.

Still further, according to the eighth invention, the bypass passage is connected to the upstream side of the inlet side switching means 31 and to the downstream side of the outlet side switching means 33, so even if both of the inlet side switching means 31 and the outlet side switching means 33 are brought into the intermediate opening state, the cold water or the hot water can be surely flowed to the outlet 22 via the bypass passage. Therefore, it is possible to surely avoid the flow of water from being intercepted and hence to protect the piping and the like from high hydraulic pressure.

Still further, according to the ninth invention, at the time of switching the flow of water, the outlet side switching means 33 for water is switched and then the inlet side switching means 31 for water is switched. Thus, during the time that passes when the flow of water is switched, the cold water or the hot water can be flowed longer, even if only a little, through the specified first heat exchanger 32 and second heat exchanger 42. Therefore, it is possible to prevent a decrease in the capacity of dehumidifying or humidifying air of each of the heat exchangers 32, 42 at the time of switching the flow of water.

Still further, according to the tenth invention, the water circuit 20 has the buffer tanks 39, 49 of the cold water and the hot water disposed upstream of the outlet side switching means 33, 43, so even when the faulty operation of the passage switching valve is caused to intercept the flow of water, the cold water and the hot water can be stored in the buffer tanks 39, 49. Therefore, it is possible to prevent high pressure from being applied to the piping and the heat exchangers 32, 42.

Still further, according to the eleventh invention, also in the water circuit 20 in which only the cold water or only the hot water flows, the buffer tanks 39, 49 of the water are disposed upstream of the outlet side switching means 33, so even when the passage switching valve causes a faulty operation to intercept the flow of the water, the cold water or the hot water can be stored in the buffer tanks 39, 49. Therefore, it is possible to prevent high pressure from being applied to the piping and the like. As a result, it is possible to protect the piping from the high pressure.

Still further, according to the twelfth invention, the flow of air is switched after the specified time passes from when the flow of the cold water or the hot water is switched, so the heat exchangers 32, 42 can be previously cooled or heated. Thus, when the cooling dehumidifying operation is performed, the first air can be supplied into the room without being heated, whereas when the cooling dehumidifying operation is performed, the second air can be supplied into the room without being cooled. With this, it is possible to enhance the comfort in the room.

Still further, according to the thirteenth invention, the flow of air is switched after the specified time passes from when the flow of the cold water is switched, so the heat exchangers 32, 42 through which the first air flows can be previously cooled. Thus, when the cooling dehumidifying operation is performed, the first air can be supplied into the room without being heated. With this, it is possible to enhance the comfort in the room.

Still further, according to the fourteenth invention, the flow of air is switched after the specified time passes from when the flow of the hot water is switched, so the heat exchangers 32, 42 through which the second air flows can be previously heated. Thus, when the cooling dehumidifying operation is performed, the second air can be supplied into the room without being cooled. With this, it is possible to enhance the comfort in the room.

Still further, according to the fifteenth invention, when the dehumidifying operation is performed, the hot water is not flowed to any of the heat exchangers 32, 42 in the intermediate state, so also in the intermediate state, the first air can be supplied into the room without being heated. With this, it is possible to further enhance the comfort in the room.

Still further, according to the sixteenth invention, when the humidifying operation is performed, the cold water is not flowed to any of the heat exchangers 32, 42 in the intermediate state. Thus, also in the intermediate state, the second air can be supplied into the room without being cooled. With this, it is possible to further enhance the comfort in the room.

Still further, according to the seventeenth or eighteenth invention, the water circuit 20 has the bypass passage through which the hot water or the cold water flows to bypass the heat exchangers 32, 42. Thus, also in the intermediate state, the first air can be supplied into the room without being heated and the second air can be supplied into the room without being cooled.

DESCRIPTION OF THE REFERENCE SYMBOLS

Figure 1:
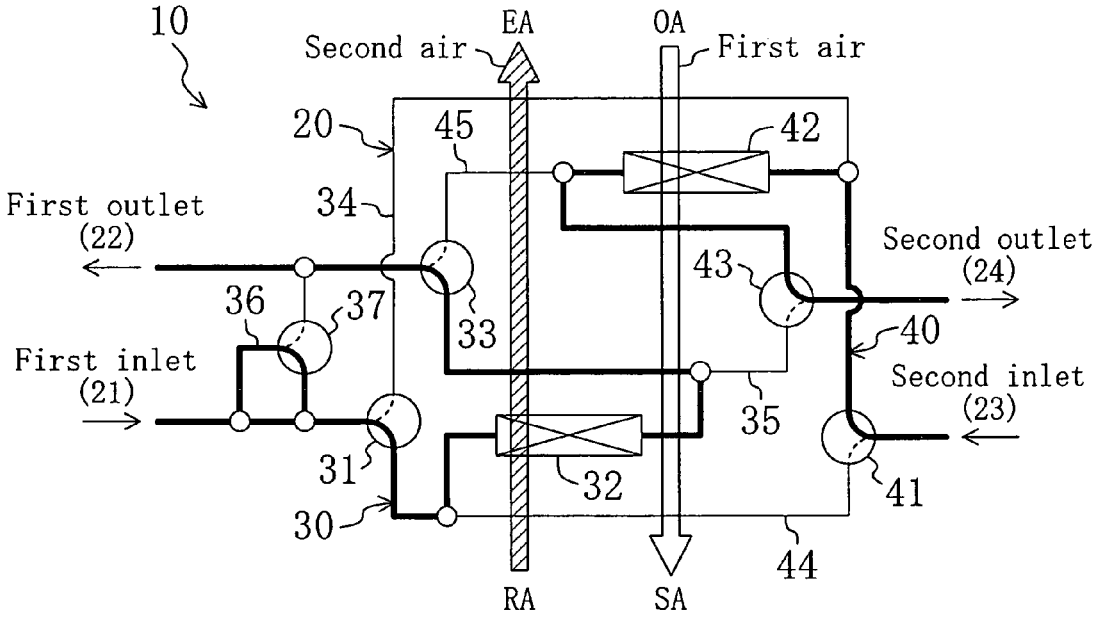
FIG. 1 is a piping diagram to show a water circuit of a humidifier according to an embodiment 1.

10 humidifier
20 water circuit
21, 23 first inlet, second inlet
22, 24 first outlet, second outlet
31, 41 inlet side three-way valve (inlet side switching means)
33, 43 outlet side three-way valve (outlet side switching means)
32 first adsorption heat exchanger (first heat exchanger)
36 bypass passage, inlet side branch passage, outlet side branch passage
37 bypass three-way valve, bypass two-way valve (bypass shutoff valve)
39, 49 buffer tank
42 second adsorption heat exchanger (second heat exchanger)

DESCRIPTION OF THE PREFERRED EMBODIMENTS

Hereinafter, the preferred embodiments of the present invention will be described in detail with reference to the drawings.

Embodiment 1 of the Invention

As shown in FIG. 1, a humidifier 10 of this embodiment is such that dehumidifies and humidifies indoor air. This humidifier 10 includes a water circuit 20 in which cold water and hot water flow and an air passage (not shown) that takes in and circulates first air and second air.

The water circuit 20 is provided with a first inlet 21 and a first outlet 22 for hot water and a second inlet 23 and a second outlet 24 for cold water.

The water circuit 20 is provided with a first passage 30 and a second passage 40. The first passage 30 is a passage for connecting the first inlet 21 and the first outlet 22 and the second passage 40 is a passage for connecting the second inlet 23 and the second outlet 24.

The first passage 30 has an inlet side three-way valve 31, a first adsorption heat exchanger 32, and an outlet side three-way valve 33 disposed in this order from the first inlet 21. The second passage 40 has an inlet side three-way valve 41, a second adsorption heat exchanger 42, and an outlet side three-way valve 43 disposed in this order from the second inlet 23.

The first passage 30 has an inlet side branch passage 34 and an outlet side branch passage 35 connected thereto, whereas the second passage 40 has an inlet side branch passage 44 and an outlet side branch passage 45 connected thereto. The inlet side branch passage 34 of the first passage 30 has its one end connected to the inlet side three-way valve 31 of the first passage 30 and has its other end connected to a portion between the inlet side three-way valve 41 and the second adsorption heat exchanger 42 in the second passage 40. The outlet side branch passage 35 of the first passage 30 has its one end connected to a portion between the first adsorption heat exchanger 32 and the outlet side three-way valve 33 in the first passage 30 and has its other end connected to the outlet side three-way valve 43 of the second passage 40. The inlet side branch passage 44 of the second passage 40 has its one end connected to an inlet side three-way valve 41 of the second passage 40 and has its other end connected to a portion between the inlet side three-way valve 31 and the first adsorption heat exchanger 32 in the first passage 30. The outlet side branch passage 45 of the second passage 40 has its one end connected to a portion between the second adsorption heat exchanger 42 and the outlet side three-way valve 43 in the second passage 40 and has its other end connected to the outlet side three-way valve 33 of the first passage 30.

The inlet side three-way valve 31 of the first passage 30 is constructed in such a way as to be switched between a first state (state shown by a solid line in FIG. 1) in which the first inlet 21 side communicates with the upstream side of the first adsorption heat exchanger 32 and a second state (state shown by a broken line in FIG. 1) in which the first inlet 21 side communicates with the inlet side branch passage 34. The outlet side three-way valve 33 of the first passage 30 is constructed in such a way as to be switched between a first state (state shown by a solid line in FIG. 1) in which the first outlet 22 side communicates with the downstream side of the first adsorption heat exchanger 32 and a second state (state shown by a broken line in FIG. 1) in which the first outlet 22 side communicates with the outlet side branch passage 45. The inlet side three-way valve 41 of the second passage 40 is constructed in such a way as to be switched between a first state (state shown by a solid line in FIG. 1) in which the second inlet 23 side communicates with the upstream side of the second adsorption heat exchanger 42 and a second state (state shown by a broken line in FIG. 1) in which the second inlet 23 side communicates with the inlet side branch passage 44. The outlet side three-way valve 43 of the second passage 40 is constructed in such a way as to be switched between a first state (state shown by a solid line in FIG. 1) in which the second outlet 24 side communicates with the downstream side of the second adsorption heat exchanger 42 and a second state (state shown by a broken line in FIG. 1) in which the second outlet 24 side communicates with the outlet side branch passage 35.

The first adsorption heat exchanger 32 and the second adsorption heat exchanger 42 are constructed of a cross-fin type fin-and-tube heat exchanger, respectively. In other words, the first adsorption heat exchanger 32 and the second adsorption heat exchanger 42 includes many fins each of which is formed of aluminum in the shape of a rectangular plate and a heat transfer tube which is formed of copper and is passed through the fins, respectively.

An adsorbent capable of adsorbing and desorbing moisture is supported on the outer surfaces of the fins and the heat transfer tube along with a binder of an adhesive by dip forming (immersion forming). As the adsorbent is used zeolite, silica gel, activated carbon, organic polymer-based material having hydrophilicity or water absorption, ion-exchange resin-based material having carboxylic acid group or sulfonic acid group, or functional polymer material such as temperature sensing polymer. The first adsorption heat exchanger 32 constructs a first heat exchanger and the second adsorption heat exchanger 42 constructs a second heat exchanger.

The water circuit 20 has the flows of cold water and hot water and the flow of air switched in such a way as to alternately repeat a first cycle operation in which hot water flows from the first inlet 21 to the first outlet 22 through the first adsorption heat exchanger 32 and in which cold water flows from the second inlet 23 to the second outlet 24 through the second adsorption heat exchanger 42 and a second cycle operation in which hot water flows from the first inlet 21 to the first outlet 22 through the second adsorption heat exchanger 42 and in which cold water flows from the second inlet 23 to the second outlet 24 through the first adsorption heat exchanger 32. In other words, the water circuit 20 has the flows of hot water and cold water switched, thereby being switched between a first flow state in which the first cycle operation is performed and a second flow state in which the second cycle operation is performed.

The inlet side three-way valve 31 and the outlet side three-way valve 33 of the first passage 30 construct hot-water inlet side switching means and hot-water outlet side switching means for switching the flow of water between the first flow state and the second flow state. Moreover, the inlet side three-way valve 41 and the outlet side three-way valve 43 of the second passage 40 construct cold-water inlet side switching means and cold-water outlet side switching means for switching the flow of water between the first flow state and the second flow state.

Specifically, in the first cycle operation, the moisture of first air is adsorbed by the adsorbent in the second adsorption heat exchanger 42 to dehumidify the first air and at the same time the first air and the adsorbent are cooled by cold water, whereas the moisture is discharged from the adsorbent into second air in the first adsorption heat exchanger 32 to humidify the second air and at the same time the second air and the adsorbent are heated by hot water. Moreover, in the second cycle operation, the moisture of the first air is adsorbed by the adsorbent in the first adsorption heat exchanger 32 to dehumidify the first air and at the same time the first air and the adsorbent are cooled by cold water, whereas the moisture is discharged from the adsorbent into the second air in the second adsorption heat exchanger 42 to humidify the second air and at the same time the second air and the adsorbent are heated by hot water.

The humidifier 10 is constructed in such a way as to be switched between a cooling dehumidifying operation and a heating humidifying operation. The flow of air is switched in such a way that at the time of the cooling dehumidifying operation, the first air is supplied into the room and the second air is discharged to the outside of the room, and that at the time of the heating humidifying operation, the second air is supplied into the room and the first air is discharged to the outside of the room.

Moreover, the humidifier 10 has a bypass passage 36 having a bypass three-way valve 37 as a feature of the present invention. This bypass passage 36 has its one end connected to a portion located upstream of the inlet side three-way valve 31 in the first passage 30 and has its other end connected to a portion located downstream of the outlet side three-way valve 33 in the first passage 30.

The bypass three-way valve 37 constructs a bypass shutoff valve that shuts off hot water passing through the bypass passage 36 to bypass the first passage 30. Specifically, this bypass three-way valve 37 is constructed in such a way as to be switched between a second state (state shown by a broken line in FIG. 1) in which hot water flowing from the first inlet 21 to the bypass passage 36 flows to the first outlet 22 without being subjected to any operation and a first state (state shown by a solid line in FIG. 1) in which hot water is returned again to the first passage 30.

In other words, the bypass passage 36 is constructed in such a way as to make hot water introduced from the first inlet 21 bypass the first adsorption heat exchanger 32 and the second adsorption heat exchanger 42 and the inlet side three-way valve 31 and the outlet side three-way valve 33 and to flow the hot water to the first outlet 22 by switching the bypass three-way valve 37 to the second state at the time of switching the flow of water. Further describing the bypass passage 36, the bypass passage 36 constructs a passage for connecting the first inlet 21 and the first outlet 22 at the time of switching the flow of water.

Moreover, in the water circuit 20, the outlet side branch passage 35 of the first passage 30 and the outlet side branch passage 45 of the second passage 40 also serve as bypass passages for connecting the respective inlets 21, 23 to the respective outlets 22, 24 at the time of switching the flow of water.

Moreover, the humidifier 10 is constructed in such a way as to switch the flow of air after a specified time passes from when the flow of water is switched at the time of switching of the water circuit 20 between the first cycle operation and the second cycle operation. For example, in the case of the cooling dehumidifying operation, the flow of air is switched after a specified time passes from when the flow of cold water is switched, whereas in the case of heating humidifying operation, the flow of air is changed after a specified time passes from when the flow of hot water is switched.

Moreover, the water circuit 20 is constructed in such a way as to switch the respective outlet side three-way valves 33, 43 and then to switch the respective inlet side three-way valves 31, 41 at the time of switching the flows of cold water and hot water. Further, in the case of the cooling dehumidifying operation, the outlet side three-way valve 33 of the first passage 30 for hot water is switched and then the outlet side three-way valve 43 of the second passage 40 for cold water is switched. On the other hand, in the case of the heating humidifying operation, the outlet side three-way valve 43 of the second passage 40 for cold water is switched and then the outlet side three-way valve 33 of the first passage 30 for hot water is switched.

Operation

The operation of the humidifier 10 will be described. This humidifier 10 can be switched between the cooling dehumidifying operation and the heating humidifying operation.

First, the cooling dehumidifying operation will be described. This cooling dehumidifying operation is an operation for supplying dehumidified first air into the room. Here, the operation of switching from the first cycle operation to the second cycle operation will be mainly described with reference to FIG. 1 to FIG. 7.

As shown in FIG. 1, the water circuit 20 is switched to the first flow state in which the first cycle operation is performed. Specifically, the respective inlet side three-way valves 31, 41 and the respective outlet side three-way valves 33, 43 are set to the first state and the bypass three-way valve 37 is set to the first state. Moreover, this humidifier 10 has the flow of air set in such a way that the outdoor air OA flows as the first air to the second adsorption heat exchange 42 and that room air RA flows as the second air to the first adsorption heat exchanger 32. Then, hot water is introduced from the first inlet 21 and cold water is introduced from the second inlet 23.

First, the hot water introduced from the first inlet 21 flows through the inlet side three-way valve 31 to the first adsorption heat exchanger 32. In this first adsorption heat exchanger 32, the adsorbent and the second air are heated by the hot water and at that time moisture is discharged from the adsorbent into the second air, whereby the second air is humidified. Thereafter, this second air is discharged as exhaust air EA to the outside of the room. The hot water discharged from the first adsorption heat exchanger 32 flows through the outlet side three-way valve 33 and then is discharged from the first outlet 22.

On the other hand, the cold water introduced from the second inlet 23 flows through the inlet side three-way valve 41 to the second adsorption heat exchanger 42. In this second adsorption heat exchanger 42, the adsorbent and the first air are cooled by the cold water and at that time moisture in the first air is adsorbed by the adsorbent, whereby the first air is dehumidified. Thereafter, this first air is supplied as supply air SA into the room. The cold water discharged from the second adsorption heat exchanger 42 flows through the outlet side three-way valve 43 and then is discharged from the second outlet 24. In other words, in this first cycle operation, the hot water flows through only the first passage 30 and the cold water flows through only the second passage 40.

When the first cycle operation is performed for a specified time, the water circuit 20 has the bypass three-way valve 37, the outlet side three-way valve 33 of the first passage 30, the outlet side three-way valve 43 of the second passage 40, the inlet side three-way valve 41 of the second passage 40, and the inlet side three-way valve 31 of the first passage 30 switched in sequence to the second state.

Figure 2:
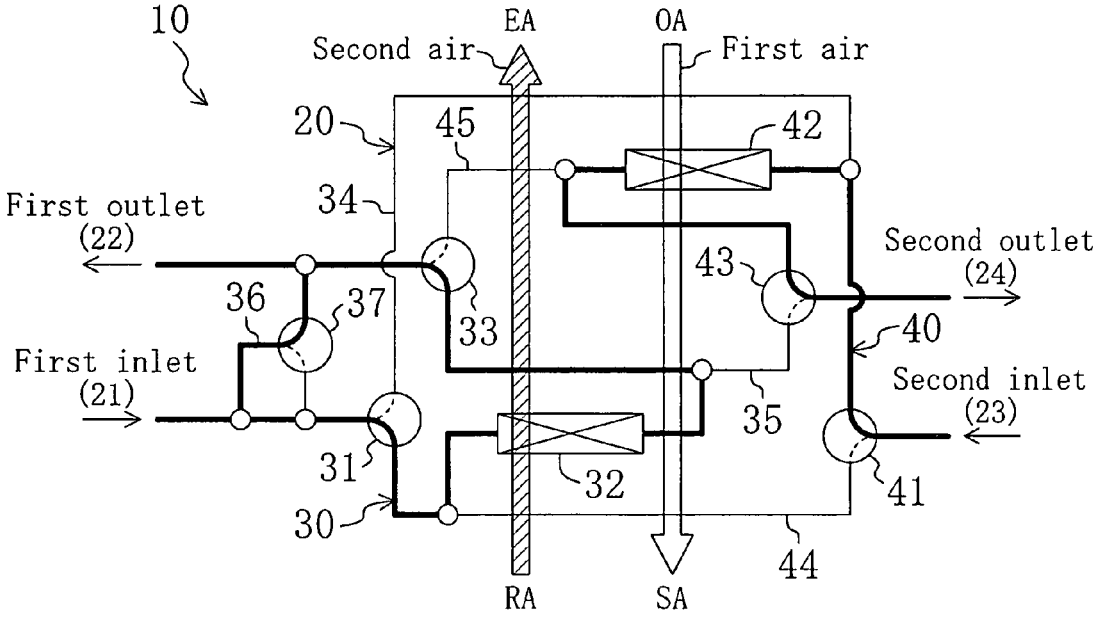
FIG. 2 is a piping diagram to show a water circuit at the time of a cooling dehumidifying operation of the humidifier according to the embodiment 1.

First, as shown in FIG. 2, when the bypass three-way valve 37 is switched to the second state, part of hot water introduced from the first inlet 21 flows to the first adsorption heat exchanger 32 and the remaining hot water branches to the bypass passage 36 and flows to the first outlet 22. In other words, in this state, two routes of hot water from the first inlet 21 to the first outlet 22 are secured.

Figure 3:
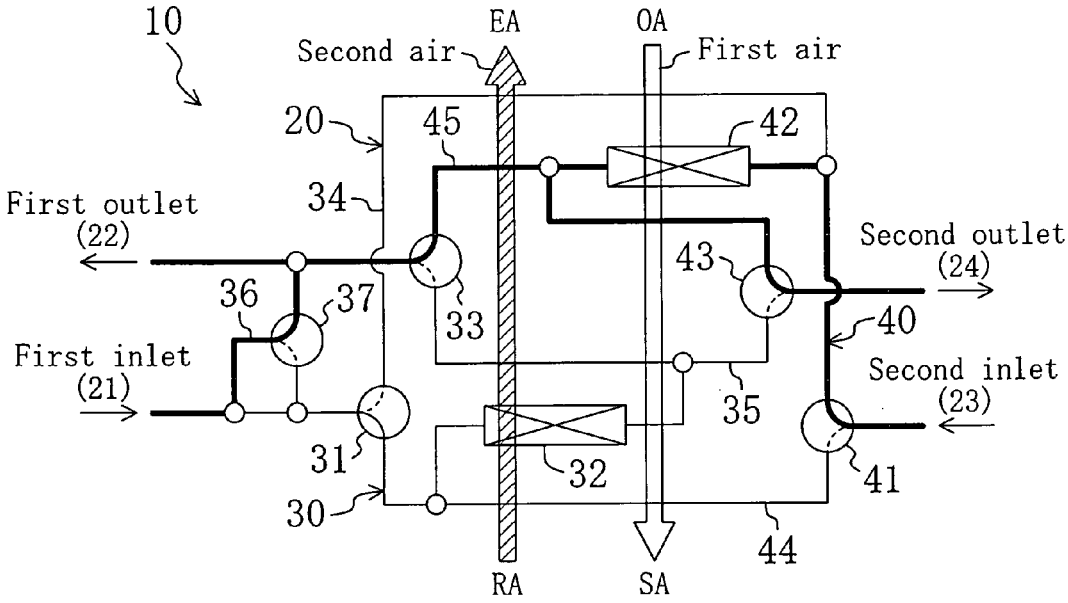
FIG. 3 is a piping diagram to show the water circuit at the time of the cooling dehumidifying operation of the humidifier according to the embodiment 1.

Subsequently, when the outlet three-way valve 33 of the first passage 30 is switched to the second state, as shown in FIG. 3, the entire amount of hot water introduced from the first inlet 21 flows through the bypass passage 36 to the first outlet 22. On the other hand, part of cold water flowing out of the second adsorption heat exchanger 42 flows to the second outlet 24 and the remaining cold water branches to the outlet side branch passage 45 from the second passage 40 and flows through the outlet three-way valve 33 of the first passage 30 to the first outlet 22. In this manner, the bypass three-way valve 37 is switched before the outlet side three-way valve 33 of the first passage 30 is switched, so it is possible to surely flow the hot water introduced from the first inlet 21 to the first outlet 22 without intercepting the flow of the hot water.

Figure 4:
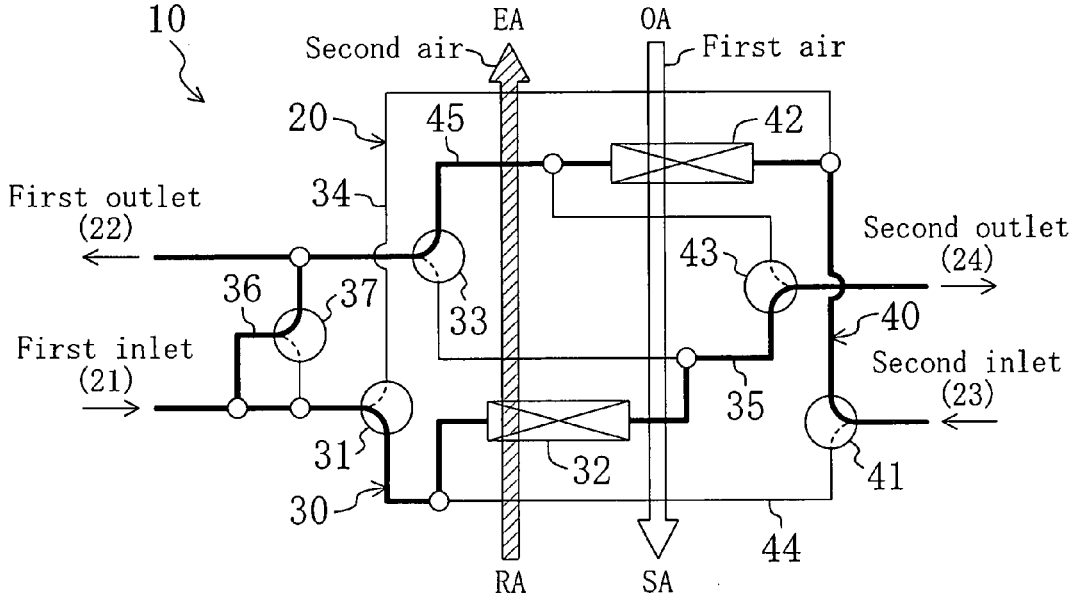
FIG. 4 is a piping diagram to show the water circuit at the time of the cooling dehumidifying operation of the humidifier according to the embodiment 1.

Subsequently, when the outlet side three-way valve 43 of the second passage 40 is switched to the second state, as shown in FIG. 4, part of hot water introduced from the first inlet 21 flows through the first adsorption heat exchanger 32 and then flows to the second outlet 24 via the outlet side branch passage 35 and the remaining hot water branches from the first passage 30 to the bypass passage 36 and flows to the first outlet 22. In other words, in this state, the hot water having flowed through the first adsorption heat exchanger 32 flows to the second outlet 24 and the entire amount of cold water having flowed through the second adsorption heat exchanger 42 flows to the first outlet 22.

In this manner, the outlet side three-way valve 33 of the first passage 30 is switched and then the outlet side three-way valve 43 of the first passage 40 is switched, so there is not a possibility that the flow of cold water will be intercepted. In other words, when the respective output side three-way valves 33, 43 are switched at the same time, for example, if the outlet side three-way valve 33 of the first passage 30 is not switched because of a faulty operation or the like, there is a possibility that the flow of cold water will be intercepted. However, if the respective outlet side three-way valves 33, 43 are switched in sequence, even if the outlet side three-way valves 33, 43 to be switched cause a faulty operation or the like, the cold water can be surely flowed to the first outlet 22 or the second outlet 24.

Figure 5:
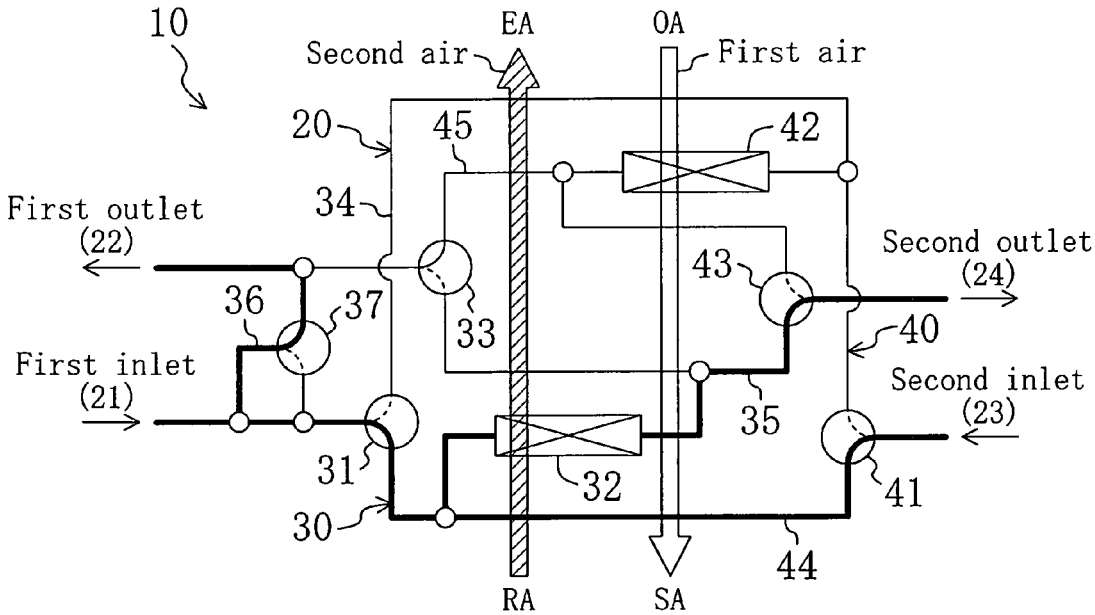
FIG. 5 is a piping diagram to show the water circuit at the time of the cooling dehumidifying operation of the humidifier according to the embodiment 1.

Further, as shown in FIG. 5, when the inlet side three-way valve 41 of the second passage 40 is switched to the second state, the water circuit 20 is switched to an intermediate state. Then, cold water introduced from the second inlet 23 flows through the inlet side branch passage 44 to the first passage 30 and then merges with part of hot water introduced from the first inlet 21 and flows to the first adsorption heat exchanger 32. On the other hand, the second adsorption heat exchanger 42 is brought into a state in which any of cold water and hot water does not flow. Also in this case, the outlet side three-way valve 33 of the first passage 30 is switched, so even if the inlet side three-way valve 41 of the second passage 40 causes faulty switching, cold water surely flows to the first outlet 22. Thus, there is not a possibility that the flow of cold water will be intercepted to rupture the piping and the like.

In this manner, the respective outlet side three-way valves 33, 43 are switched I earlier than the respective inlet side three-way valves 31, 41 are switched, and the outlet side three-way valve 33 of the first passage 30 is switched and then the outlet side three-way valve 43 of the second passage 40 is switched. Thus, the cold water can be flowed to the second adsorption heat exchanger 42 of the use side as long as possible when the flow of water is switched. With this, it is possible to prevent a decrease in the capability of dehumidifying air.

In this intermediate state, the first adsorption heat exchanger 32 has hot heat left by the hot water having flowed therethrough until that time but is gradually cooled by cold water merging with the hot water and flowing therethrough. At this time, the second air is cooled and is discharged outside the room. On the other hand, the second adsorption heat exchanger 42 has cold heat left by the cold water having flowed therethrough until that time, so the first air is cooled by the left cold heat and is supplied into the room. Further, the second adsorption heat exchanger 42 has the hot water not flowed therethrough and hence is not heated by the hot water, so it is possible to surely prevent the second adsorption heat exchanger 42 from heating the first air. In other words, in this intermediate state, only the flow of cold water is switched from the first cycle operation to the next second cycle operation, whereas the flow (supply) of hot water to the second adsorption heat exchanger 42 of the use side is intercepted. Further, in this intermediate state, the hot water flows into the bypass passage 36 and hence the hot water bypasses the second adsorption heat exchanger 42.

Figure 6:
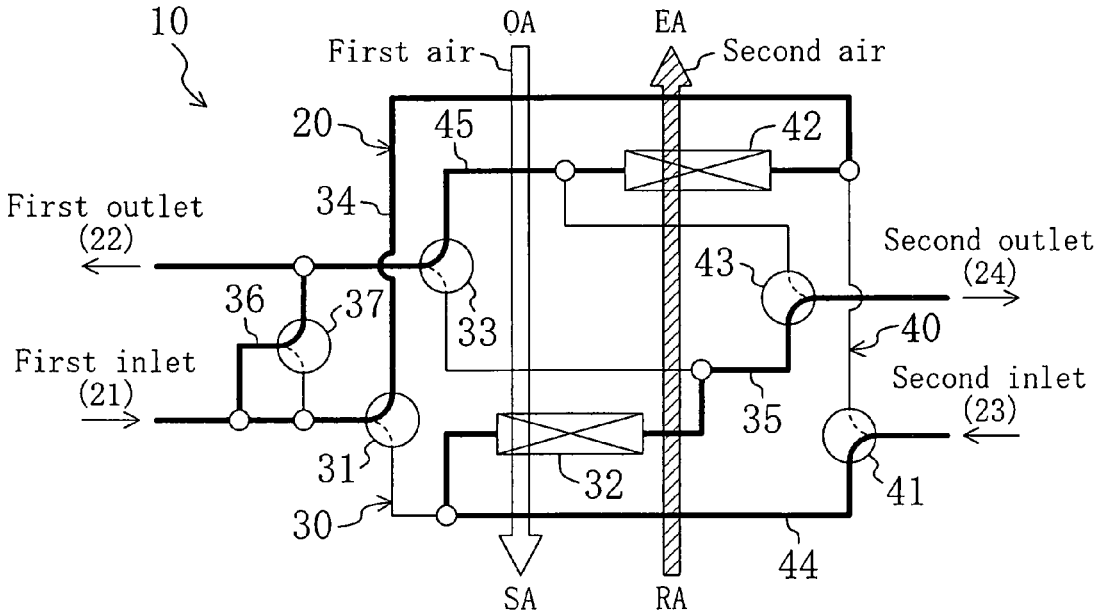
FIG. 6 is a piping diagram to show the water circuit at the time of the cooling dehumidifying operation of the humidifier according to the embodiment 1.

As shown in FIG. 6, when a specified time passes from when the water circuit 20 is switched to the intermediate state, the inlet side three-way valve 31 of the first passage 30 is switched to the second state and the flow of air is switched, whereby the second cycle operation is performed. In other words, the flow of air is switched in such a way that the outside air OA as the first air flows into the first adsorption heat exchanger 32 and that the room air RA as the second air flows into the second adsorption heat exchanger 42.

Figure 7:
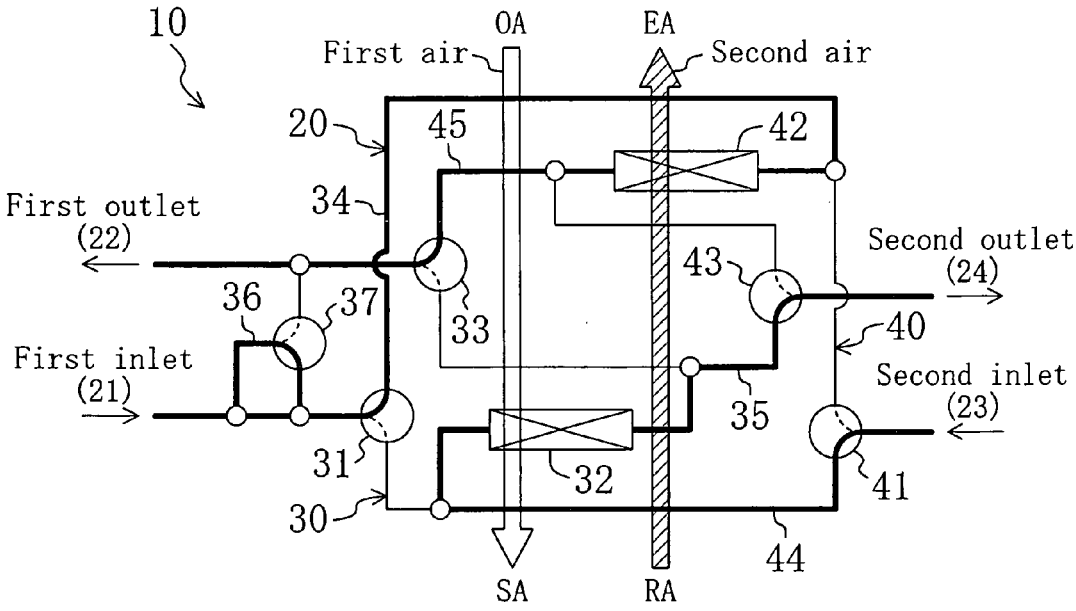
FIG. 7 is a piping diagram to show the water circuit at the time of the cooling dehumidifying operation of the humidifier according to the embodiment 1.

In the second adsorption heat exchanger 42, the adsorbent and the second air are heated by the hot water and at that time the second air is humidified and is discharged as exhaust air EA to the outside of the room. On the other hand, in the first adsorption heat exchanger 32, the adsorbent and the first air are cooled by the cold water and at that time the first air is dehumidified and is supplied as supply air SA into the room. Here, the first adsorption heat exchanger 32 heated in the first cycle operation is cooled by the cold water during a specified time in the intermediate state. Hence, it dose not happen that after switching to the second cycle operation, the first air is heated by the first adsorption heat exchanger 32 and is supplied into the room, so comfort in the room is not impaired. In the water circuit 20, as shown in FIG. 7, the bypass three-way valve 37 is switched to the first state, whereby the switching to the second state in which the second cycle operation is performed is completed.

The switching of the water circuit 20 from the second cycle operation to the first cycle operation is performed in the same way as the above-mentioned switching operation. In other words, in the water circuit 20, when the second cycle operation is performed for a specified time, the bypass three-way valve 37 is switched to the second state and then the outlet side three-way valve 33 of the first passage 30, the outlet side three-way valve 43 of the second passage 40, and the inlet side three-way valve 41 of the second passage 40 are switched in sequence to the first state, whereby the water circuit 20 is brought into the intermediate state. When a specified time passes in this intermediate state, the inlet side three-way valve 31 of the first passage 30 is switched to the first state and the flow of air is switched in such a way that the first air flows into the second adsorption heat exchanger 42 and that the second air flows into the first adsorption heat exchanger 32. Then, finally, the bypass three-way valve 37 is switched to the first state, whereby the switching of the water circuit 20 to the first flow state in which the first cycle operation is performed is completed. Thus, also in this case, the flows of the cold water and the hot water are not intercepted and hence there is not a possibility that the piping or the like will be ruptured.

Next, the heating humidifying operation will be described. This heating humidifying operation is the operation of supplying the humidified second air into the room. In other words, in the case of this operation, the room air RA is taken in as the first air and the outdoor air OA is taken in as the second air.

For example, when the water circuit 20 is switched from the first cycle operation to the second cycle operation, the bypass three-way valve 37, the outlet side three-way valve 43 of the second passage 40, the outlet side three-way valve 33 of the first passage 30, the inlet side three-way valve 31 of the first passage 30, and the inlet side three-way valve 41 of the second passage 40 are switched in sequence to the second state. Then, the bypass three-way valve 37 is switched to the first state, whereby the switching of the water circuit 20 to the second cycle operation is completed. Also in this case, the flows of the cold water and the hot water are not intercepted and hence there is not a possibility that the piping and the like will be ruptured. Further, when the water circuit 20 is switched from the second cycle operation to the first cycle operation, the bypass three-way valve 37 is switched to the second state, and then the outlet side three-way valve 43 of the second passage 40, the outlet side three-way valve 33 of the first passage 30, the inlet side three-way valve 31 of the first passage 30, and the inlet side three-way valve 41 of the second passage 40 are switched in sequence to the first state, and then the bypass three-way valve 37 is switched to the first state, whereby the switching of the water circuit 20 to the first cycle operation is completed.

In this regard, in this embodiment, an ON/OFF valve of a two way valve may be used in place of the bypass three-way valve 37. In this case, the two-way valve is set to a closed state while the water circuit 20 performs the first cycle operation and the second cycle operation, whereas the two-way valve is set to an open state while the water circuit 20 is switched to the first cycle operation and the second cycle operation. In other words, the two-way valve is switched in such a way that the closed state of the two-way valve corresponds to the first state of the bypass three-way valve 37 and that the open state of the two-way valve corresponds to the second state of the bypass three-way valve 37.

Effect of Embodiment 1

As described above, the water circuit 20 is provided with the bypass passage 36 for connecting the first inlet 21 with the first outlet 22 when the flow of water is switched and the respective outlet side branch passages 35, 45 also serve as bypass passages for connecting the respective inlets 21, 23 with the respective outlets 22, 24 when the flow of water is switched. Hence, even if the respective three-way valves 31, 33, 41, 43 cause a faulty operation or the like, water introduced from the first inlet 21 can be surely flowed to the first outlet 22. As a result, it is possible to prevent the flows of the cold water and the hot water from being intercepted. With this, it is possible to prevent high pressure from being applied to the piping and the heat exchangers 32, 42.

Further, when the flow of water is switched, the respective outlet side three-way valves 33, 43 are switched earlier, so the cold water and the hot water can be flowed through the respective heat exchangers 32, 42 for a longer time even if only a little. Hence, it is possible to prevent a decrease in the capability of dehumidifying and humidifying air at the time of switching the flow of water.

Still further, in the case of the cooling dehumidifying operation, the outlet side three-way valve 33 of the first passage 30 is switched and then the outlet side three-way valve 43 of the second passage 40 is switched, whereas in the case of the heating humidifying operation, the outlet side three-way valve 43 of the second passage 40 is switched and then the outlet side three-way valve 33 of the first passage 30 is switched. Hence, the cold water and the hot water can be flowed to the heat exchangers 32, 43 of the use side for a longer time even if only a little. Thus, it is possible to further prevent a decrease in the capability of dehumidifying and humidifying air at the time of switching the flow of water.

Still further, before the water circuit 20 is switched to the first cycle operation and the second cycle operation, the water circuit 20 keeps the intermediate state in which only the flow of cold water is switched for a specified time and then the flow of air is switched, so the adsorption heat exchangers 32, 42 that have humidified the second air can be cooled by the cold water. Thus, it does not happen that immediately after the flow of air is switched, the first air is heated by the adsorption heat exchangers 32, 42 and is supplied into the room. Therefore, it is possible to enhance comfort in the room.

Still further, in the intermediate state, the first air is cooled by cold heat remaining in the adsorption heat exchangers 32, 42, so comfort in the room is not impaired even in the intermediate state. Still further, in the intermediate state, hot water does not flow through any of the adsorption heat exchangers 32, 42, so it is possible to surely cool the first air and to supply the first air into the room. As a result, it is possible to further enhance the comfort in the room.

Embodiment 2 of the Invention

A humidifier 10 of this embodiment 2 uses a plurality of two-way valves 3*a*, 4*a*, 3*b*, 4*b*, . . . in place of various three-way valves 31, 33, 41, 43, . . . that are used as passage switching means of the water circuit 20 in the embodiment 1.

Figure 8:
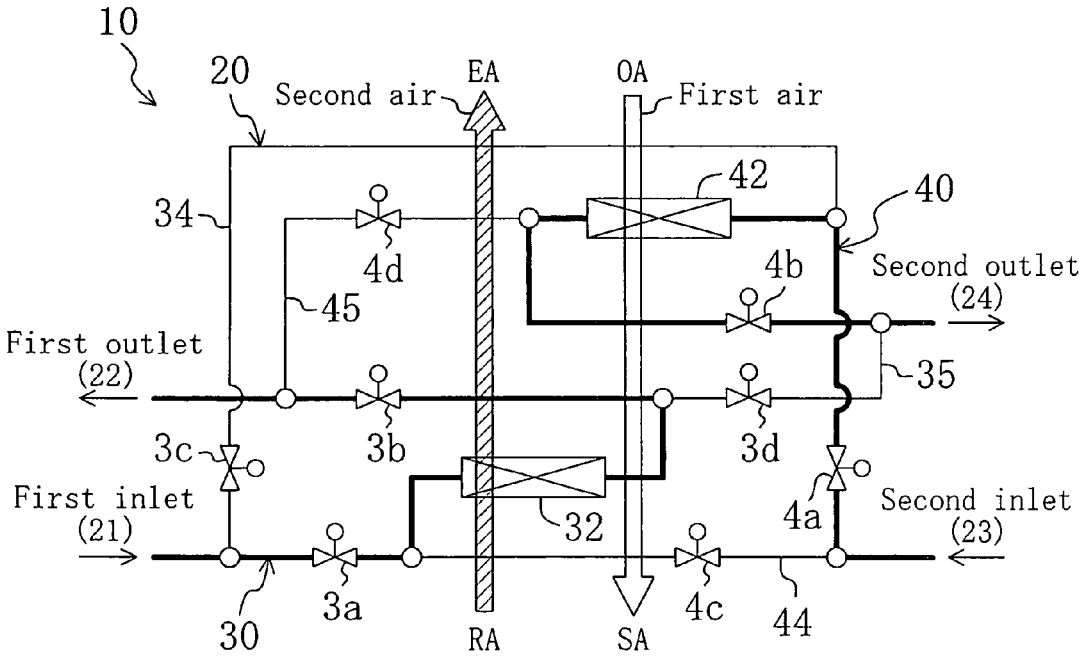
FIG. 8 is a piping diagram to show a piping diagram to show a water circuit of a humidifier according to an embodiment 2.

As shown in FIG. 8, the first passage 30 has a second two-way valve 3*a*, the first adsorption heat exchanger 32, and a second two-way valve 3*b* disposed in the order closer to the first inlet 21. The second passage 40 has a first two-way valve 4*a*, the second adsorption heat exchanger 42, and a second two-way valve 4*b* disposed in the order closer to the second inlet 23. The first passage 30 has the inlet side branch passage 34 and the outlet side branch passage 35 connected thereto, and the second passage 40 has the inlet side branch passage 44 and the outlet side branch passage 45 connected thereto, just as with the embodiment 1.

The inlet side branch passage 34 of the first passage 30 has a third two-way valve 3*c* disposed in the midway and has its one end connected to the upstream side of the first two-way valve 3*a* in the first passage 30 and has its other end connected to a portion located between the first two-way valve 4*a* and the second adsorption heat exchanger 42, which are disposed in the second passage 40. The first two-way valve 3*a* of the first passage 30 and the third two-way valve 3*c* of the inlet side branch passage 34 construct inlet side switching means for hot water.

The outlet side branch passage 35 of the first passage 30 has a fourth two-way valve 3*d* disposed in the midway and has its one end connected to a portion located between the first adsorption heat exchanger 32 and the second two-way valve 3*b*, which are disposed in the first passage 30, and has the other end connected to the downstream side of the second two-way valve 4*b* in the second passage 40. The fourth two-way valve 3*d* of the outlet side branch passage 35 and the second two-way valve 4*b* of the second passage 40 construct outlet side switching means for cold water.

The inlet side branch passage 44 of the second passage 40 has a third two-way valve 4*c* disposed in the midway and has its one end connected to the upstream side of the first two-way valve 4*a* in the second passage 40 and has its other end connected to a portion located between the first two-way valve 3*a* and the first adsorption heat exchanger 32, which are disposed in the first passage 30. The first two-way valve 4*a* of the second passage 40 and the third two-way valve 4*c* of the inlet side branch passage 44 construct inlet side switching means for cold water.

The outlet side branch passage 45 of the second passage 40 has a fourth two-way valve 4*d* disposed in the midway and has its one end connected to a portion located between the second adsorption heat exchanger 42 and the second two-way valve 4*b*, which are disposed in the second passage 40, and has its other end connected to the downstream side of the second two-way valve 3*b* in the first passage 30. The second two-way valve 3*b* of the first passage 30 and the fourth two-way valve 4*d* of the outlet side branch passage 45 construct outlet side switching means for hot water. In other words, eight two-way valves are used for the water circuit 20.

Further, also in this embodiment, just as with the embodiment 1, the respective inlet side branch passages 34, 44 and the respective outlet side branch passages 35, 45 also serve as bypass passages for connecting the respective inlets 21, 23 with the respective outlets 22, 24 at the time of switching the flow of water.

Next, the cooling dehumidifying operation in this embodiment will be described with reference to FIG. 8 to FIG. 12.

First, as shown in FIG. 8, the water circuit 20 is switched to the first flow state in which the first cycle operation is performed. Specifically, the respective first two-way valves 3*a*, 4*a* and the respective second two-way valves 3*b*, 4*b* are set to the open state and the respective third two-way valves 3*c*, 4*c* and the respective fourth two-way valves 3*d*, 4*d* are set to the closed state. Here, the flow of air and the introduction ports of cold water and hot water are the same as those in the embodiment 1. In this state, hot water introduced from the first inlet 21 heats the adsorbent and the second air in the first adsorption heat exchanger 32 and flows to the first outlet 22 and at that time humidifies the second air. Cold water introduced from the second inlet 23 cools the adsorbent and the first air in the second adsorption heat exchanger 42 and flows to the second outlet 24 and at that time dehumidifies the first air.

Figure 9:
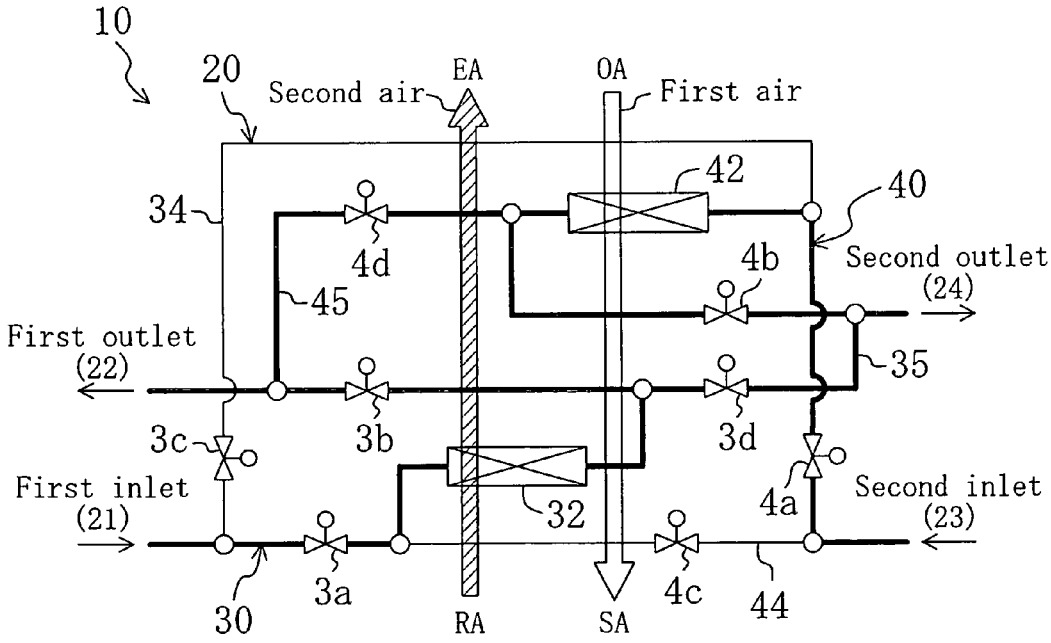
FIG. 9 is a piping diagram to show a water circuit at the time of a cooling dehumidifying operation of the humidifier according to the embodiment 2.

When the water circuit 20 performs the first cycle operation for a specified time, as shown in FIG. 9, the respective fourth two-way valves 3*d*, 4*d* are switched to the open state. In this state, part of hot water flowing out of the first adsorption heat exchanger 32 flows to the first outlet 22 and the remaining amount of the hot water flows through the outlet side branch passage 35 to the second outlet 24. Further, part of cold water flowing out of the second adsorption heat exchanger 42 merges with hot water in the first passage 30 and flows to the second outlet 22 and the remaining amount of the cold water flows through the outlet side branch passage 45 and merges with the hot water in the first passage 30 and flows to the first outlet 22. In other words, in this state, two routes to the outlets of the hot water introduced from the first inlet 21 can be secured and two routes to the outlets of the cold water introduced from the second inlet 23 can be secured.

Figure 10:
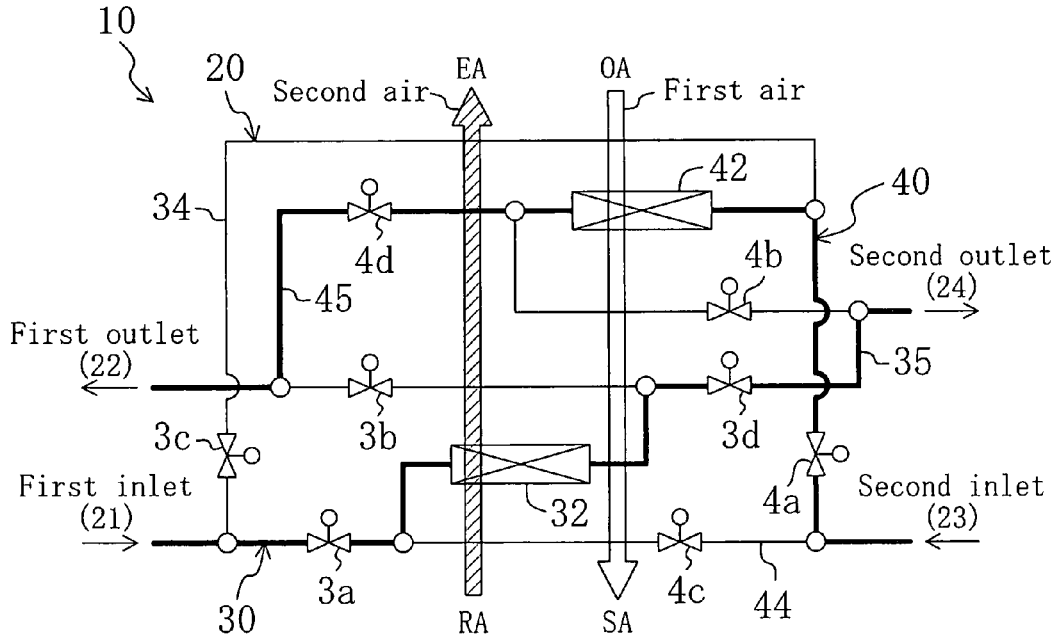
FIG. 10 is a piping diagram to show the water circuit at the time of the cooling dehumidifying operation of the humidifier according to the embodiment 2.

Subsequently, as shown in FIG. 10, the water circuit 20 has the respective second two-way valves 3*b*, 4*b* switched to the closed state. In this state, the entire amount of hot water flowing out of the first adsorption heat exchanger 32 flows to the second outlet 24 and the entire amount of cold water flowing out of the second adsorption heat exchanger 42 flows to the first outlet 22. Here, even if the respective second two-way valves 3*b*, 4*b* causes a faulty operation, two routes to the outlets of the cold water and two routes to the outlets of the hot water are secured previously, so it does not happen that the flows of the cold water and the hot water are intercepted.

Figure 11:
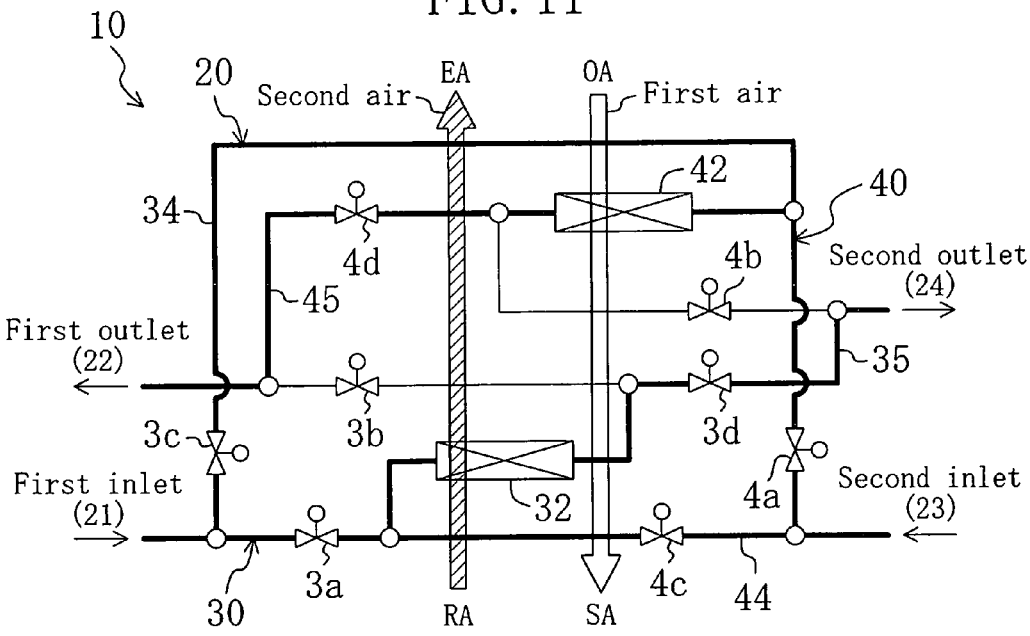
FIG. 11 is a piping diagram to show the water circuit at the time of the cooling dehumidifying operation of the humidifier according to the embodiment 2.

Subsequently, as shown in FIG. 11, the water circuit 20 has the respective third two-way valves 3*c*, 4*c* switched to the open state. In this state, part of hot water introduced from the first inlet 21 and part of cold water introduced from the second inlet 23 flow through the first adsorption heat exchanger 32 to the second outlet 24. Further, the remaining amount of the hot water introduced from the first inlet 21 and the remaining amount of the cold water introduced from the second inlet 23 flow through the second adsorption heat exchanger 42 to the first outlet 22. The first adsorption heat exchanger 32 is slightly cooled because the flow of cold water is added, whereas the second adsorption heat exchanger 42 is slightly heated because the flow of hot water is added.

Figure 12:
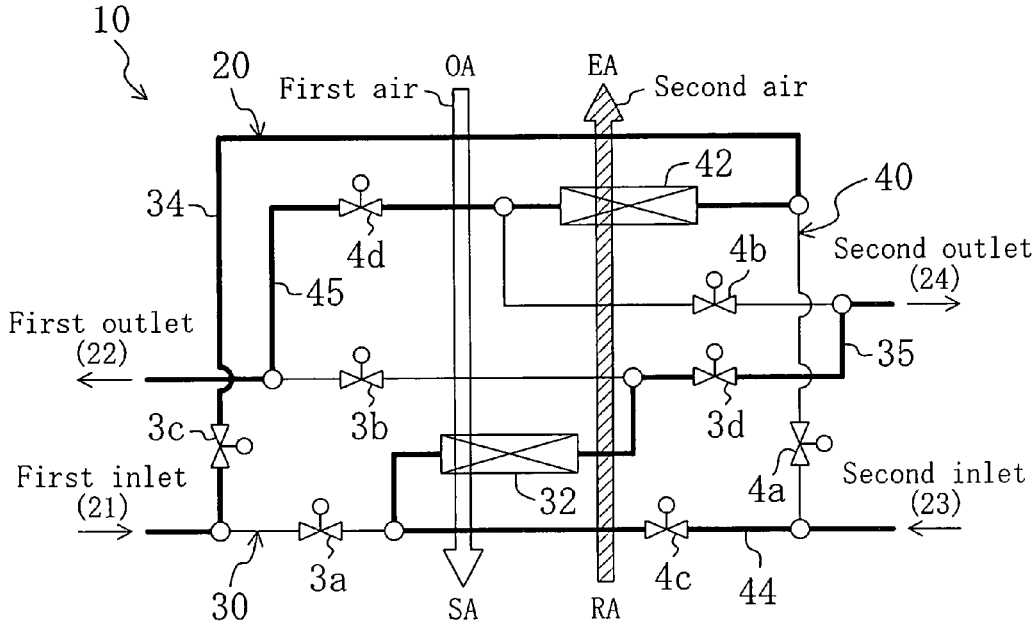
FIG. 12 is a piping diagram to show the water circuit at the time of the cooling dehumidifying operation of the humidifier according to the embodiment 2.

As shown in FIG. 12, the water circuit 20 has the respective first two-way valves 3*a*, 4*a* set to the closed state from the above-mentioned state and has the flow of air switched, thereby being switched to the second flow state in which the second cycle operation is performed. Here, even if the respective first two-way valves 3*a*, 4*a* cause a faulty operation or the like, because two routes to the outlets of the cold water and two routes to the outlets of the hot water are previously secured, it does not happen that the flows of cold water and hot water are intercepted. In this second cycle operation, the hot water introduced from the first inlet 21 heats the adsorbent and the second air in the second adsorption heat exchanger 42 and then flows to the first outlet 21. At that time, the second air is humidified. The cold water introduced from the second inlet 23 cools the adsorbent and the first air in the first adsorption heat exchanger 32 and then flows to the second outlet 24. At that time, the first air is dehumidified.

When the water circuit 20 is switched from the second cycle operation to the first cycle operation, although not shown in the drawing, the respective second two-way valves 3*b*, 4*b* are switched to the open state and the respective fourth two-way valves 3*d*, 4*d* are switched to the closed state in sequence. Thereafter, the respective first two-way valves 3*a*, 4*a* are switched to the open state and then the respective third two-way valves 3*c*, 4*c* are switched to the closed state. At that time, the flow of air is switched in such a way that the first air flows to the second adsorption heat exchanger 42 and that the second air flows to the first adsorption heat exchanger 32, whereby the switching of the water circuit 20 to the first cycle operation is completed. In this manner, the water circuit 20 is alternately switched to the first cycle operation and the second cycle operation, whereby the cooling dehumidifying operation is continuously performed.

Next, the heating humidifying operation will be described. In this heating humidifying operation, the room air RA is taken in as the first air and is dehumidified and then is discharged to the outside of the room, whereas the outdoor air OA is taken in as the second air and is humidified and then is supplied into the room. In other words, for example, in the first cycle operation, the first air flows to the second adsorption heat exchanger 42 and the second air flows to the first adsorption heat exchanger 32. In this heating humidifying operation, the same switching operation as in the cooling dehumidifying operation is performed, whereby the water circuit 20 is switched to the first cycle operation and the second cycle operation. The other construction, operation, and effect are the same as those in the embodiment 1.

Modification of Embodiment 2

Figure 13:
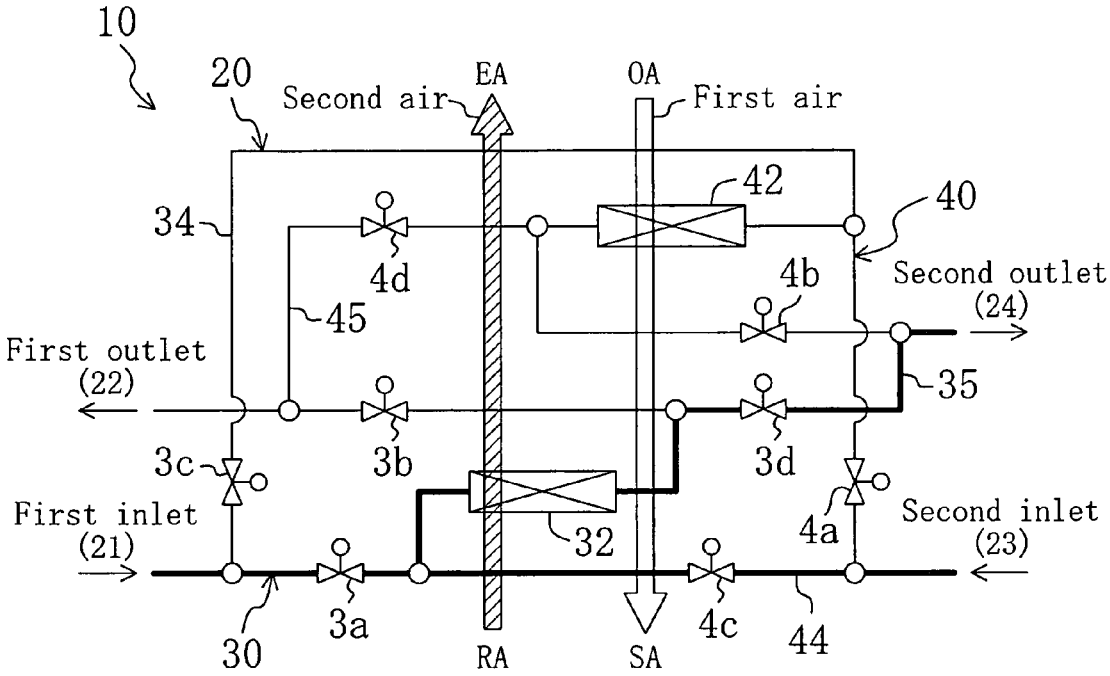
FIG. 13 is a piping diagram to show a water circuit at the time of a cooling dehumidifying operation of a humidifier according to a modification of the embodiment 2.

This modification is such that, when the water circuit 20 is switched to the first cycle operation and the second cycle operation in the embodiment 2, the water circuit 20 is switched to an intermediate state. In other words, when the water circuit 20 is switched from the first cycle operation to the second cycle operation, in the embodiment 2, by switching the two third two-way valves 3*c*, 4*c* to the open state, the water circuit 20 is switched from the state shown in FIG. 10 to the state shown in FIG. 11, but in this modification, the water circuit 20 is switched from the state shown in FIG. 10 to the intermediate state shown in FIG. 13.

Specifically, the water circuit 20 has the first two-way valve 4*a* of the second passage 40 switched to the closed state and has the third two-way valve 4*c* of the inlet side branch passage 44 of the second passage 40 switched to the open state, thereby being switched to the intermediate state. In this intermediate state, cold water introduced from the second inlet 23 flows through the inlet side branch passage 44 to the first passage 30 and merges with hot water and then flows to the first adsorption heat exchanger 32. This first adsorption heat exchanger 32 is gradually cooled because the flow of cold water is added. On the other hand, any of the hot water and the cold water does not flow through the second adsorption heat exchanger 42. Hence, the first air is cooled by cold heat remaining in the second adsorption heat exchanger 42. In other words, in the intermediate state of the cooling dehumidifying operation, just as with the embodiment 1, only the flow of cold water is switched and the flow (supply) of hot water to the second adsorption heat exchanger 42 of the use side is intercepted.

When a specified time passes after the water circuit 20 is switched to the intermediate state, the third two-way valve 4*c* of the inlet side branch passage 44 of the first passage 30 is switched to the open state and the first two-way valve 3*a* of the first passage 30 is switched to the closed state and the flow of air is switched, whereby the second cycle operation is performed (see FIG. 12). In this second cycle operation, as described above, the second air is humidified by the second adsorption heat exchanger 42 and the first air is dehumidified by the first adsorption heat exchanger 32. Here, the first adsorption heat exchanger 32 heated in the first cycle operation, just as with the embodiment 1, is cooled by cold water during a specified time in the intermediate state, so the first air is not heated but cooled and then is supplied into the room. Hence, it is possible to enhance the comfort in the room.

When the water circuit 20 is switched from the second cycle operation to the first cycle operation, although not shown in the drawing, the respective second two-way valves 3*b*, 4*b* are switched to the open state and the respective third two-way valves 3*c*, 4*c* are switched to the closed state in sequence, and then the first two-way valves 4*a* of the second passage 40 is switched to the open state and the third two-way valve 4*c* of the inlet side branch passage 44 of the second passage 40 is switched to the closed state, respectively, where the water circuit 20 is switched to the intermediate state. In this intermediate state, cold water and hot water flows through the second adsorption heat exchanger 42 to the second outlet 24. Thereafter, when a specified time passes as the water circuit 20 is in the intermediate state, the water circuit 20 has the first two-way valve 3*a* of the first passage 30 switched to the open state and has the third two-way valve 3*c* of the inlet side branch passage 44 of the first passage 30 switched to the closed state, respectively, and the flow of air is switched in such a way that the first air flows to the second adsorption heat exchanger 42 and that the second air flows to the first adsorption heat exchanger 32. With this, the switching of the water circuit 20 from the second cycle operation to the first cycle operation is completed. Here, also in the heating humidifying operation, the same switching operation described above is performed.

Further, in this modification, both of the flow of cold water and the flow of hot water may be switched at the same time in the intermediate state. Specifically, by switching the two first two-way valves 3*a*, 4*a* to the closed state and at the same time by switching the two third two-way valves 3*c*, 4*c* to the open state, the water circuit 20 is switched from the state shown in FIG. 10 to the flow state of cold water and hot water (intermediate state) shown in FIG. 12. At that time, the flow of air is not switched. When a specified time passes as the water circuit 20 is in the intermediate state, the flow of air is switched. In this case, in the intermediate state of the cooling dehumidifying operation, the adsorption heat exchangers 32, 42 in which the first air flows are gradually heated by hot water, but because cold heat remains therein, the first air is not much heated and is supplied into the room. In other words, the first air is not heated further than in the case where the flow of air is switched at the same time when the flows of cold water and hot water are switched. This is the same for the case of the heating humidifying operation.

Embodiment 3 of the Invention

Figure 14:
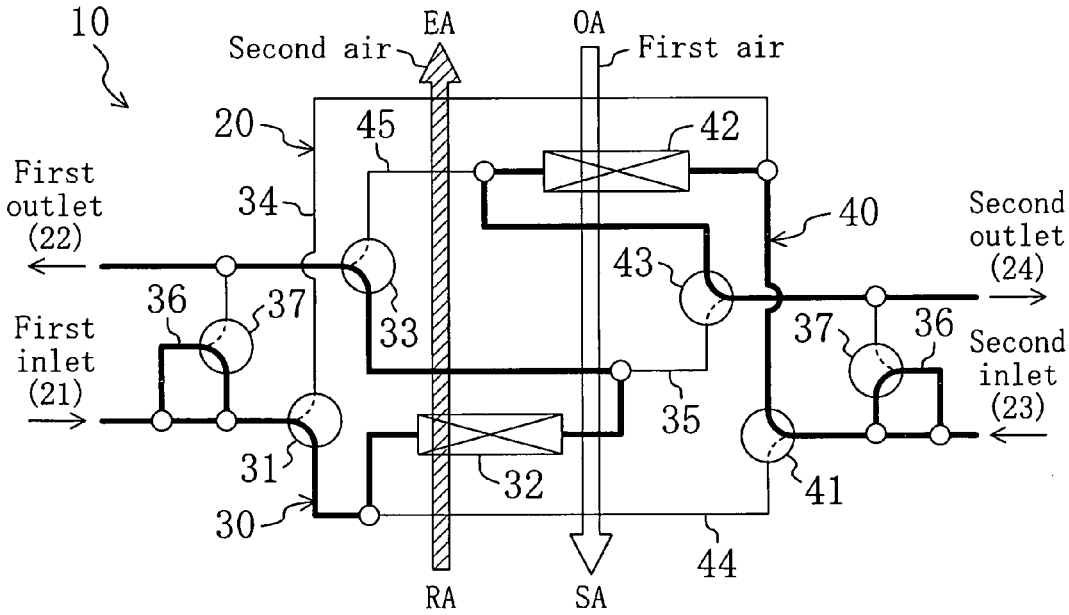
FIG. 14 is a piping diagram to show a piping diagram to show a water circuit of a humidifier according to an embodiment 3.

A humidifier 10 of this embodiment 3, as shown in FIG. 14, is such that in the water circuit 20 of the embodiment 1, a bypass passage 36 having a bypass three-way valve 37 is additionally disposed in the second passage 40. In other words, this embodiment 3 is a humidifier that is additionally provided with the bypass passage 36 for cold water in addition to the bypass passage 36 for hot water.

The bypass passage 36 additionally disposed in the second passage 40, just as with the bypass passage 36 in the first passage 30, has its one end connected to a portion closer to the second inlet 23 than the inlet side three-way valve 41 in the second passage 40 and has its other end connected to a portion closer to the second outlet 24 than the outlet side three-way valve 43 in the second passage 40. The above-mentioned bypass three-way valve 37 is constructed in such a way to switch between the second state (state shown by a broken line in FIG. 1) in which cold water flowing from the second inlet 23 to the bypass passage 36 flows to the second outlet 24 without being subjected any operation and the first state (state shown by a solid line in FIG. 1) in which cold water returns to the second passage 40.

That is, the bypass passage 36 is constructed in such a way at to make cold water introduced from the second inlet 23 bypass the first adsorption heat exchanger 32 and the second adsorption heat exchanger 42 to flow the cold water to the second outlet 24 without subjecting the cold water to any operation. In this regard, in this embodiment, hot water is introduced from the first inlet 21 in a fixed manner and cold water is introduced from the second inlet 23 in a fixed manner. Hence, in this embodiment, the water circuit 20 is provided with the bypass 36 exclusive to hot water and the bypass 36 exclusive to cold water.

Next, the cooling dehumidifying operation in this embodiment will be described with reference to FIG. 14 to FIG. 18. Here, only the operation and effect different from those of the embodiment 1 will be described.

Figure 15:
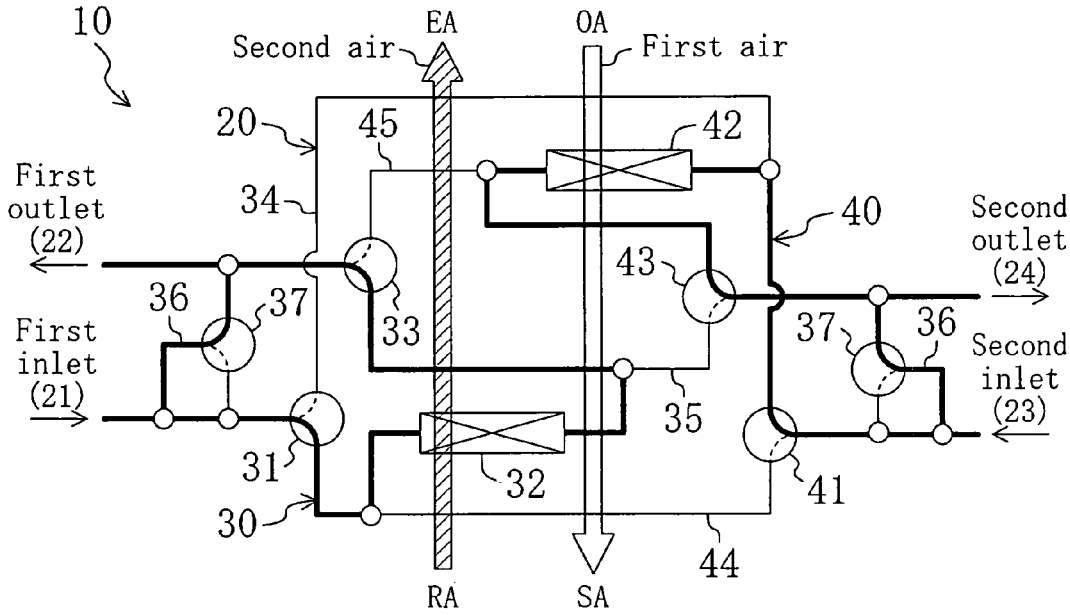
FIG. 15 is a piping diagram to show a water circuit at the time of a cooling dehumidifying operation of the humidifier according to the embodiment 3.

First, as shown in FIG. 14, the water circuit 20 is switched in such a way as to perform the first cycle operation. Specifically, two bypass three-way valves 37 are set to the first state. Then, as shown in FIG. 15, the two bypass three-way valves 37 are switched to the second state.

Figure 16:
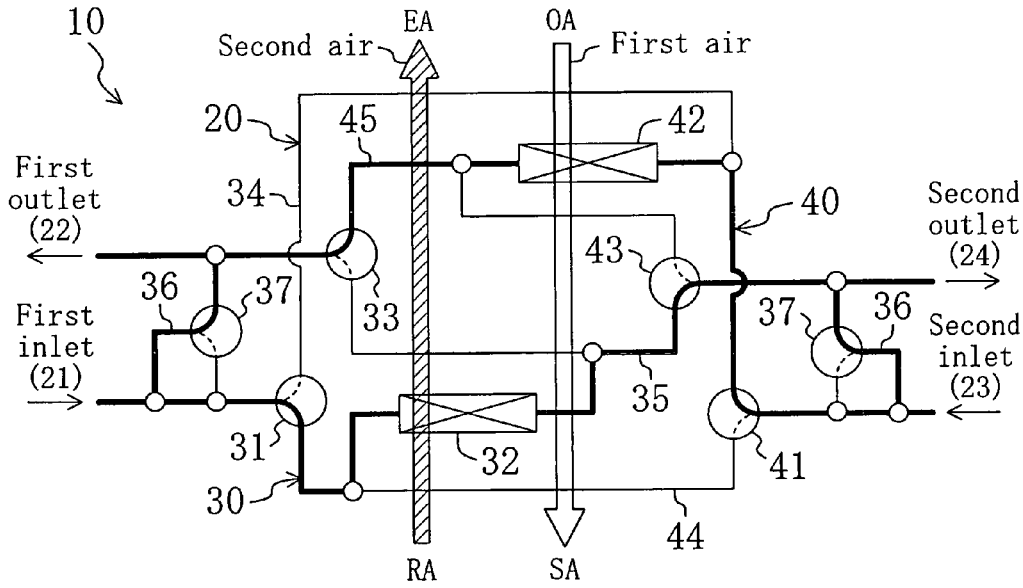
FIG. 16 is a piping diagram to show the water circuit at the time of the cooling dehumidifying operation of the humidifier according to the embodiment 3.

Subsequently, as shown in FIG. 16, the respective outlet side three-way valves 33, 43 are switched to the second state nearly at the same time. In other words, in this embodiment, as described above, the respective bypass passages 36 for hot water and cold water are disposed, so even if the respective outlet side three-way valves 33, 43 cause a faulty operation, it is possible to surely prevent the flows of hot water and cold water from being intercepted. Thus, it is possible to prevent the piping and the like from being ruptured.

Figure 17:
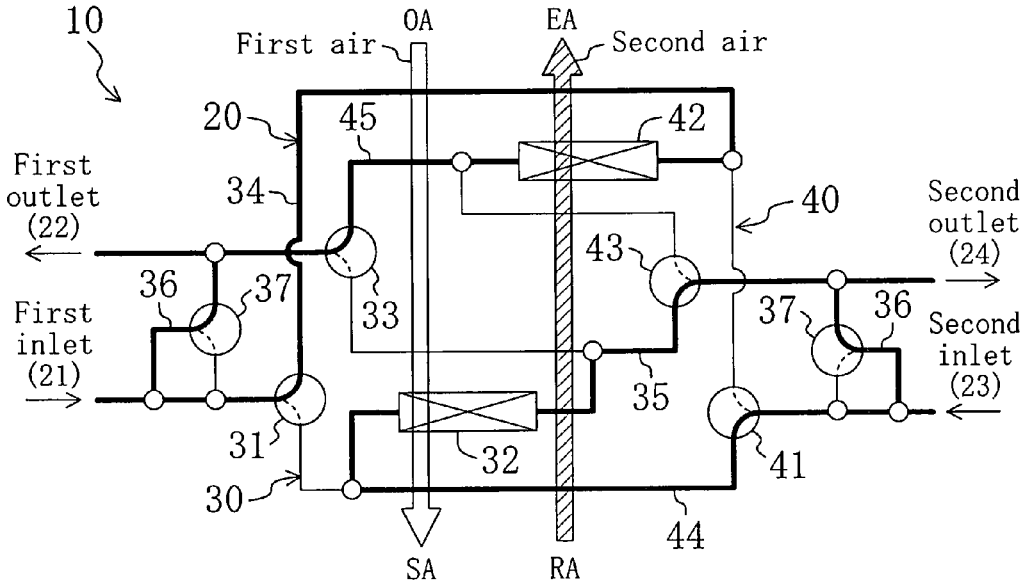
FIG. 17 is a piping diagram to show the water circuit at the time of the cooling dehumidifying operation of the humidifier according to the embodiment 3.
Figure 18:
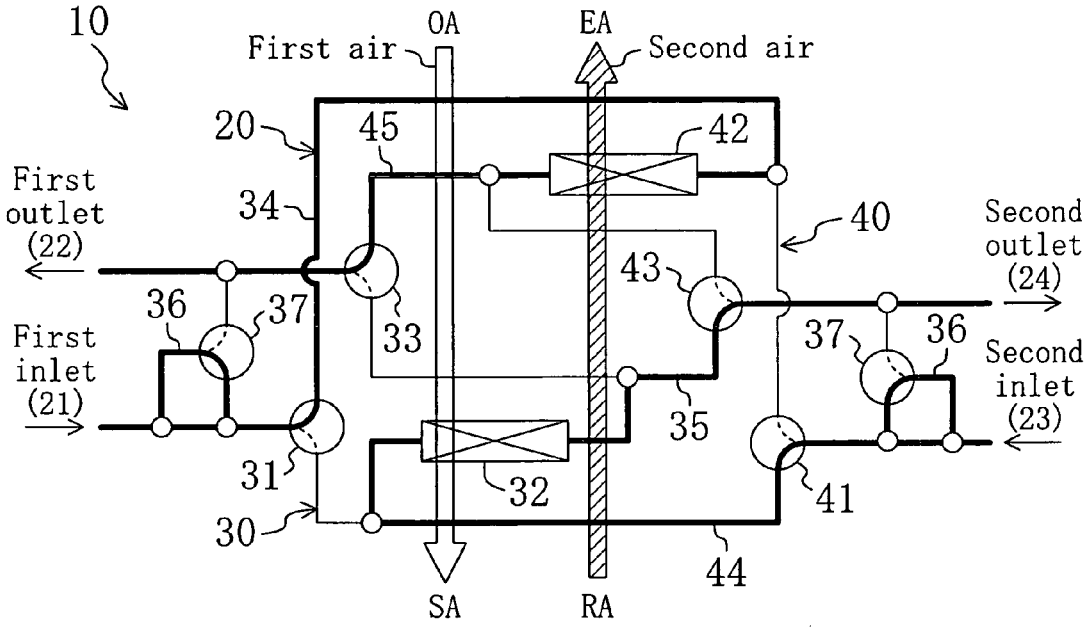
FIG. 18 is a piping diagram to show the water circuit at the time of the cooling dehumidifying operation of the humidifier according to the embodiment 3.

Subsequently, as shown in FIG. 17, the respective inlet side three-way valves 31, 41 are switched to the second state nearly at the same time. Also in this case, as described above, even if the respective inlet side three-way valves 31, 41 cause a faulty operation, it is possible to surely prevent the flows of hot water and cold water from being intercepted. Then, as shown in FIG. 18, both of the two bypass three-way valves 37 are switched to the first state, whereby the switching of the water circuit 20 to the second cycle operation is completed. In this manner, in the case of this embodiment, the steps of switching the operation are decreased in number, so the time required to switch the operation can be shortened. The other construction, operation, and effect are the same as those in the embodiment 1.

Embodiment 4 of the Invention

Figure 19:
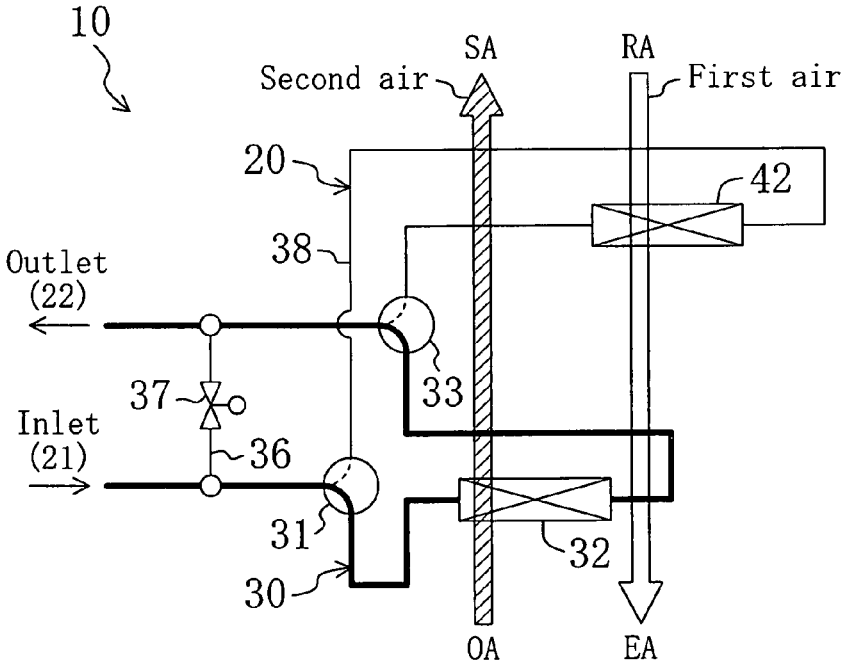
FIG. 19 is a piping diagram to show a piping diagram to show a water circuit of a humidifier according to an embodiment 4.
Figure 20:
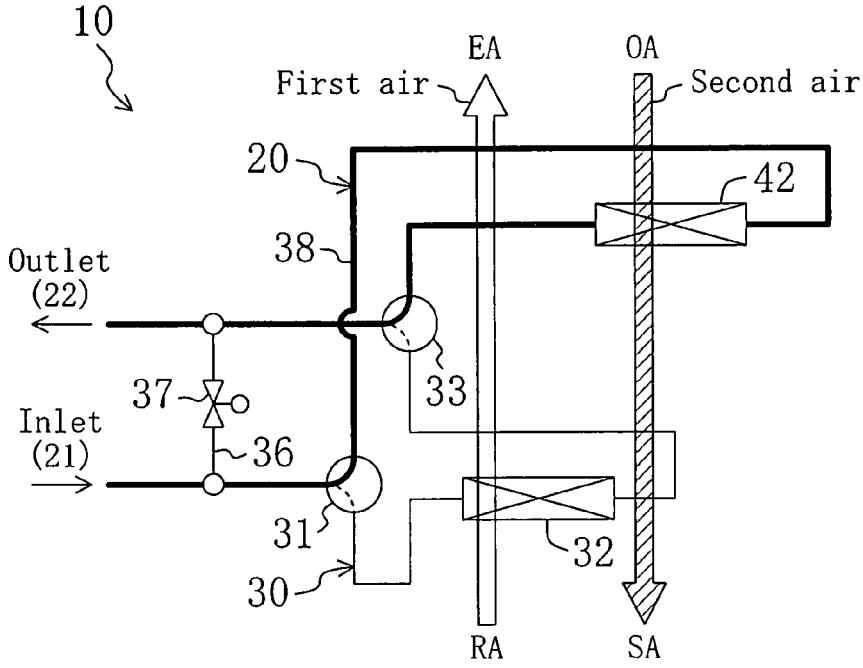
FIG. 20 is a piping diagram to show a piping diagram to show the water circuit of the humidifier according to the embodiment 4.

In a humidifier 10 of this embodiment 4, as shown in FIG. 19 and FIG. 20, the water circuit 20 is constructed of a circuit in which only hot water flows. Specifically, the water circuit 20 has one inlet 21 and one outlet 22 for hot water. The water circuit 20 has the same first passage 30 as in the embodiment 1 and a second passage 38 the construction of which is changed from that of the embodiment 1. The first passage 30 is such that connects the inlet 21 to the outlet 22 and has an inlet side three-way valve 31, the first adsorption heat exchanger 32, and an outlet side three-way valve 33 disposed in the order closer to the inlet 21. The second passage 38 has the second adsorption heat exchanger 42 in the midway and is connected to the inlet side three-way valve 31 and the outlet side three-way valve 33.

The water circuit 20 is constructed in such a way that the first cycle operation (first flow state) in which hot water introduced from the inlet 21 flows through the first adsorption heat exchanger 32 and then flows to the outlet 22, as shown in FIG. 19, and the second cycle operation (second flow state) in which the hot water introduced from the inlet 21 flows to the second passage 38 and flows through the second adsorption heat exchanger 42 and then flows to the outlet 22, as shown in FIG. 19, are alternately performed by switching the inlet side three-way valve 31 and the outlet side three-way valve 33. In other words, the inlet side three-way valve 31 and the outlet side three-way valve 33 construct inlet side switching means and outlet side switching means that switch the flow of hot water between the first flow state and the second flow state. Further, this humidifier 10 can switch between the cooling dehumidifying operation and the heating humidifying operation. Here, FIG. 19 and FIG. 20 show the heating humidifying operation.

For example, in the case of the heating humidifying operation, the flow of air is switched in such a way that the outdoor air OA is taken as the second air into the first adsorption heat exchanger 32 or the second adsorption heat exchanger 42 through which hot water flows, thereby being humidified, and then is supplied into the room (see FIG. 19 and FIG. 20). Further, in the case of the cooling dehumidifying operation, although not shown in the drawing, the flow of air is switched in such a way that the outdoor air OA is taken as the first air into the second adsorption heat exchanger 42 or the first adsorption heat exchanger 32 through which the hot water does not flow, thereby being dehumidified, and then is supplied into the room.

The water circuit 20 is provided with a bypass passage 36. This bypass passage 36 has its one end connected to a portion closer to the inlet 21 than the inlet side three-way valve 31 in the first passage 30 and has its other end connected to a portion closer to the outlet 22 than the outlet side three-way valve 33 in the first passage 30. This bypass passage 36 is provided with a bypass two-way valve 37 of a bypass shut-off valve.

Next, the switching of the water circuit 20 from the first cycle operation to the second cycle operation at the time of the heating humidifying operation will be described. First, when the first cycle operation is performed for a specified time, the bypass two-way valve 37 is switched to the open state. Subsequently, the outlet side three-way valve 33 is switched to the second state and then the inlet side three-way valve 31 is switched to the second state. Thereafter, the bypass two-way valve 37 is switched to the closed state and at the same time the flow of air is switched.

In this manner, the outlet side three-way valve 33 is switched earlier than the inlet side three-way valve 31, so hot water can be flowed through the first adsorption heat exchanger 32 as long as possible. With this, it is possible to prevent a decrease in the capability of humidifying air. Here, the bypass two-way valve 37 is previously opened, so even if the outlet side three-way valve 33 is switched, hot water introduced from the inlet 21 can be surely flowed to the outlet 22 through the bypass passage 36. Hence, it is possible to prevent high pressure from being applied to the piping and the heat exchangers 32, 42. The other construction, operation, and effect are the same as those in the embodiment 1. Here, in this embodiment, of course, a three-way valve may be used for the bypass two-way valve 37.

Further, in this embodiment, the flow of air is switched at the same time when the bypass two-way valve 37 is switched, but the flow of air may be switched after a specified time passes from when the bypass two-way valve 37 is switched to the closed state. In other words, the water circuit 20 is switched to the same intermediate state as in the embodiment 1 for a specified time from when the bypass two-way valve 37 is switched to the closed state. With this, in the case of the heating humidifying operation, the adsorption heat exchangers 32, 42 are previously heated by hot water before the second air flows. Thus, even immediately after the flow of air is switched, warm air can be surely supplied into the room, so the comfort in the room is not impaired.

Modification of Embodiment 4

Figure 21:
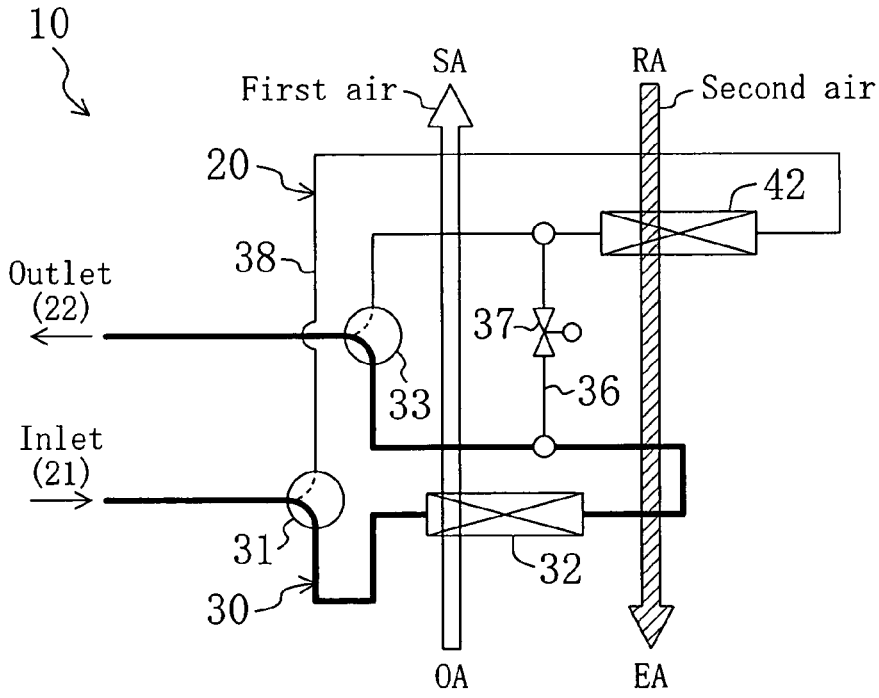
FIG. 21 is a piping diagram to show a piping diagram to show a water circuit of a humidifier according to a modification of the embodiment 4.
Figure 22:
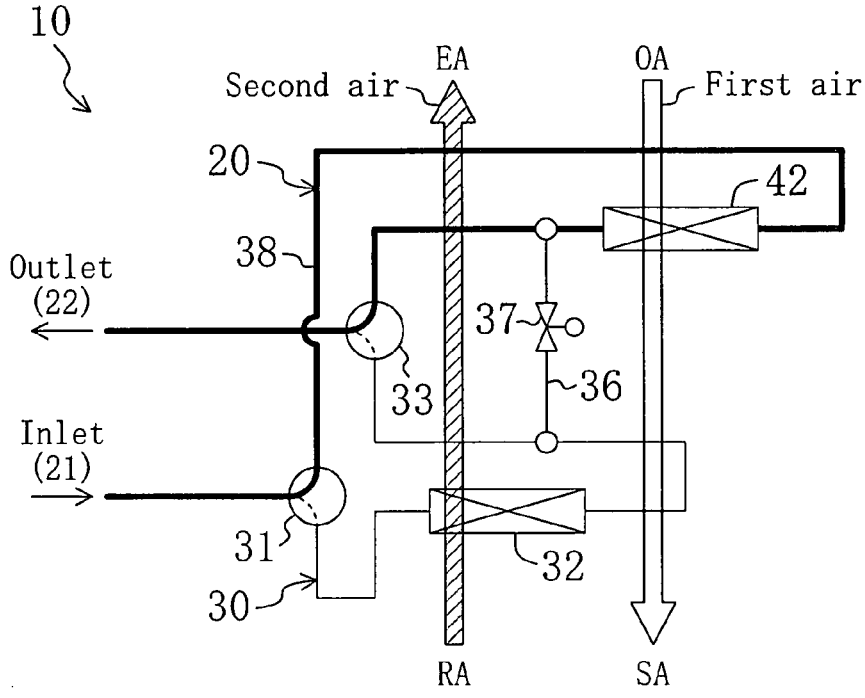
FIG. 22 is a piping diagram to show a piping diagram to show the water circuit of the humidifier according to the modification of the embodiment 4.

While the embodiment 4 has the water circuit 20 constructed of a circuit in which only hot water flows, this modification has the water circuit 20 constructed of a circuit in which only cold water flows, as shown in FIG. 21 and FIG. 22. Further, in this modification, the bypass passage 36 and the bypass two-way valve 37 in the embodiment 4 are changed in positions.

Specifically, the water circuit 20 is constructed in such a way that the first cycle operation (state shown in FIG. 21) in which cold water introduced from the inlet 21 flows through the first adsorption heat exchanger 32 and then flows to the outlet 22 and the second cycle operation (state shown in FIG. 22) in which cold water introduced from the inlet 21 flows to the second passage 38 and flows through the second adsorption heat exchanger 42 and then flows to the outlet 22 are alternately performed by switching the inlet side three-way valve 31 and the outlet side three-way valve 33. Further, this humidifier 10 can switch between the cooling dehumidifying operation and the heating humidifying operation. Here, FIG. 21 and FIG. 22 show the cooling dehumidifying operation.

For example, in the case of the cooling dehumidifying operation, the flow of air is switched in such a way that the outdoor air OA is taken as the first air into the first adsorption heat exchanger 32 or the second adsorption heat exchanger 42 through which cold water flows, thereby being dehumidified, and then is supplied into the room (see FIG. 21 and FIG. 22). Further, in the case of the heating humidifying operation, although not shown in the drawing, the flow of air is switched in such a way that the outdoor air OA is taken as the second air into the second adsorption heat exchanger 42 or the first adsorption heat exchanger 32 through which the cold water does not flow, thereby being humidified, and then is supplied into the room.

The bypass passage 36 has its one end connected to a portion between the first adsorption heat exchanger 32 and the outlet side three-way valve 33 which are disposed in the first passage 30 and has its other end connected to the downstream side of the second adsorption heat exchanger 42 in the second passage 40. In other words, this bypass passage 36 is connected to the downstream side of the first adsorption heat exchanger 32 and the downstream side of the second adsorption heat exchanger 42. Further, in the middle of this bypass passage 36 is disposed the bypass two-way valve 37 of a bypass shut-off valve.

In this modification, the switching of the water circuit 20 to the first cycle operation and the second cycle operation is performed in the same way as in the embodiment 4. In other words, for example, when the water circuit 20 is switched from the first cycle operation to the second cycle operation at the time of the cooling dehumidifying operation, the outlet side three-way valve 33 is switched earlier than the inlet side three-way valve 31, so cold water can be flowed through the first adsorption heat exchanger 32 as long as possible. With this, it is possible to prevent a decrease in dehumidifying capability. Here, the bypass two-way valve 37 is previously opened, so even if the outside three-way valve 33 is switched, it is possible to surely flow cold water having flowed out of the first adsorption heat exchanger 32, without intercepting the flow of cold water, to the second passage 38 through the bypass passage 36 and then to the outlet 22 through the outlet side three-way valve 33. Thus, it is possible to prevent high pressure from being applied to the piping and the heat exchangers 32, 42.

Here, in this embodiment, the bypass passage 36 may be connected to the upstream side of the first adsorption heat exchanger 32 and the upstream side of the second adsorption heat exchanger 42 or may be connected to the upstream side of the first adsorption heat exchanger 32 and the downstream side of the second adsorption heat exchanger 42.

Further, also in this modification, the flow of air may be switched after a specified time passes from when the bypass two-way valve 37 is switched to the closed state. With this, in the case of the cooling dehumidifying operation, the adsorption heat exchangers 32, 42 can be previously cooled by cold water before the first air flows. Thus, even immediately after the flow of air is switched, cold air can be surely supplied into the room and hence the comfort in the room is not impaired.

Embodiment 5 of the Invention

Figure 23:
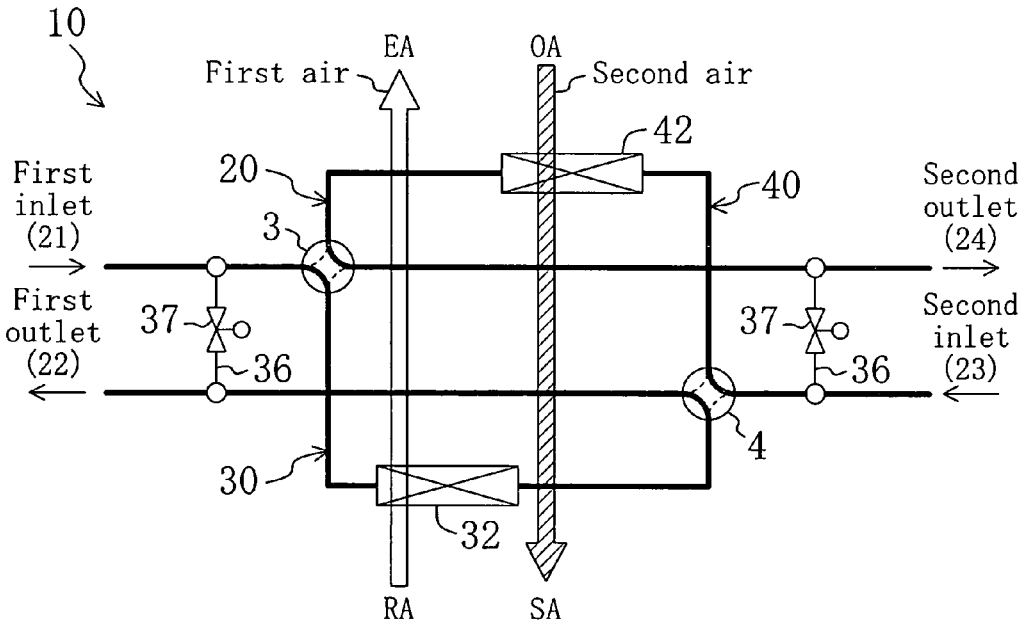
FIG. 23 is a piping diagram to show a piping diagram to show a water circuit of a humidifier according to an embodiment 5.
Figure 24:
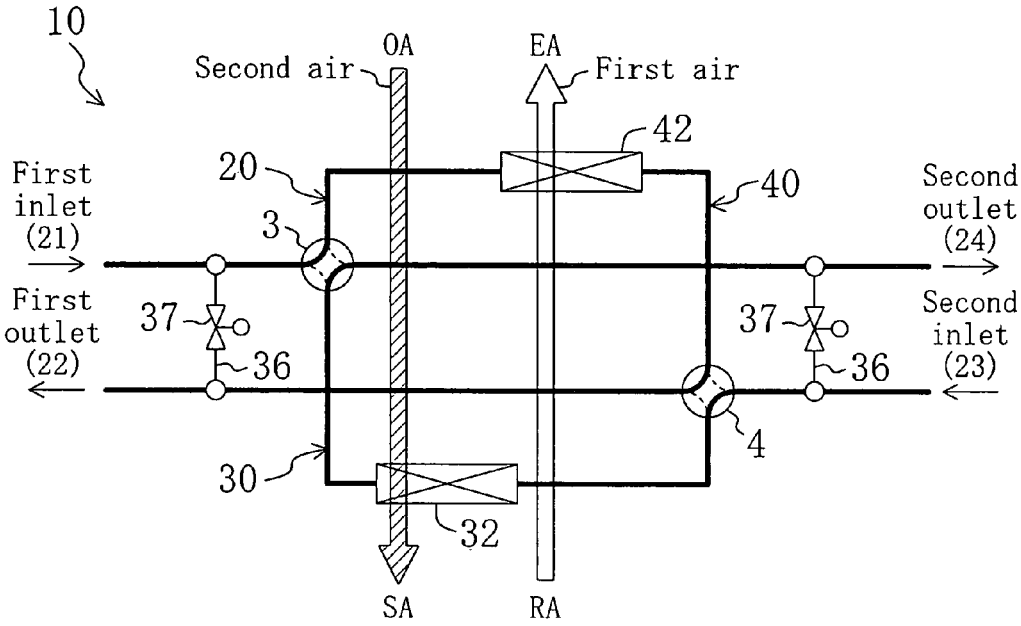
FIG. 24 is a piping diagram to show a piping diagram to show the water circuit of the humidifier according to the embodiment 5.

A humidifier 10 of this embodiment 5, as shown in FIG. 23 and FIG. 24, uses two four-way valves 3, 4 as passage switching means, in place of the four three-way valves 31, 33, . . . used as passage switching means in the embodiment 1. Here, in this embodiment 5, cold water is introduced from the first inlet 21 in a fixed manner and hot water is introduced from the first inlet 23 in a fixed manner.

Specifically, the water circuit 20 is provided with the first passage 30 having the first adsorption heat exchanger 32 disposed in the middle and the second passage 40 having the second adsorption heat exchanger 42 disposed in the middle. Here, in this embodiment 5, the respective branch passages 34, 35, 44, 45 in the embodiment 1 are omitted. The first four-way valve 3 is connected to the first inlet 21 of the first adsorption heat exchanger 32 in the first passage 30 and the second outlet 24 of the second adsorption heat exchanger 42 in the second passage 40. The second four-way valve 4 is connected to the first outlet 22 of the first adsorption heat exchanger 32 in the first passage 30 and the second inlet 23 of the second adsorption heat exchanger 42 in the second passage 40.

The first four-way valve 3 is constructed in such a way as to switch between a state (state shown by a solid line in FIG. 23) in which the first inlet 21 communicates with one end of the first adsorption heat exchanger 32 and in which one end of the second adsorption heat exchanger 42 communicates with the second outlet 24 and a state (state shown by a solid line in FIG. 24) in which the first inlet 21 communicates with one end of the second adsorption heat exchanger 42 and in which one end of the first adsorption heat exchanger 32 communicates with the second outlet 24. The second four-way valve 4 is constructed in such a way as to switch between a state (state shown by a solid line in FIG. 23) in which the other end of the first adsorption heat exchanger 32 communicates with the first outlet 22 and in which the second inlet 23 communicates with the other end of the second adsorption heat exchanger 42 and a state (state shown by a solid line in FIG. 24) in which the second inlet 23 communicates with the other end of the first adsorption heat exchanger 32 and in which the other end of the second adsorption heat exchanger 42 communicates with the first outlet 22.

That is, when the first four-way valve 3 and the second four-way valve 4 are switched to the state shown by the solid line in FIG. 23, the water circuit 20 performs the first cycle operation in which cold water flows through the first adsorption heat exchanger 32 to the first outlet 22 and in which hot water flows through the second adsorption heat exchanger 42 to the second outlet 24. At that time, the first air is dehumidified by the first adsorption heat exchanger 32 and the second air is humidified by the second adsorption heat exchanger 42. Further, when the first four-way valve 3 and the second four-way valve 4 are switched to the state shown by the solid line in FIG. 24, the water circuit 20 performs the second cycle operation in which cold water flows through the second adsorption heat exchanger 42 to the first outlet 22 and in which hot water flows through the first adsorption heat exchanger 32 to the second outlet 24. At that time, the second air is humidified by the first adsorption heat exchanger 32 and the first air is dehumidified by the second adsorption heat exchanger 42.

The humidifier 10 can switch between the cooling dehumidifying operation and the heating humidifying operation. Here, FIG. 21 and FIG. 22 show the heating humidifying operation.

For example, in the case of the heating humidifying operation, the flow of air is switched in such a way that the outdoor air OA is taken as the second air into the first adsorption heat exchanger 32 or the second adsorption heat exchanger 42 in which hot water flows, thereby being humidified, and then is supplied into the room (see FIG. 23 and FIG. 24). Further, in the case of the cooling dehumidifying operation, although not shown in the drawing, the flow of air is switched in such a way that the outdoor air OA is taken as the first air into the first adsorption heat exchanger 32 or the second adsorption heat exchanger 42 in which cold water flows, thereby being dehumidified, and then is supplied into the room.

Further, the water circuit 20 has two bypass passages 36 disposed therein. One of these bypass passages 36 is connected to a portion closer to the first inlet 21 than the first four-way valve 3 and to a portion closer to the first outlet 22 than the second four-way valve 4 in the first passage 30. Another bypass passage 36 is connected to a portion closer to the second outlet 24 than the first four-way valve 3 and to a portion closer to the second inlet 23 than the second four-way valve 4 in the second passage 40.

The respective bypass passages 36 have bypass two-way valves 37 of the bypass shutoff valves disposed therein. These respective bypass two-way valves 37 are constructed in such a way as to be switched from the closed state to the open state before the first four-way valve 3 and the second four-way valve 4 are switched. With this, when the water circuit 20 is switched to the first cycle operation and the second cycle operation, for example, even if both of the first four-way valve 3 and the second four-way valve 4 are brought into an intermediate open state because of the faulty operations, cold water and hot water flow through the respective bypass passages 36 to the first outlet 22 and the second outlet 24, so the flows of cold water and hot water are not intercepted. Thus, it is possible to prevent the piping and the like from being ruptured. The other construction, operation, and effect are the same as those in the embodiment 1. Here, in this embodiment 5, of course, three-way valves may be used for the bypass two-way valves 37.

Embodiment 6 of the Invention

Figure 25:
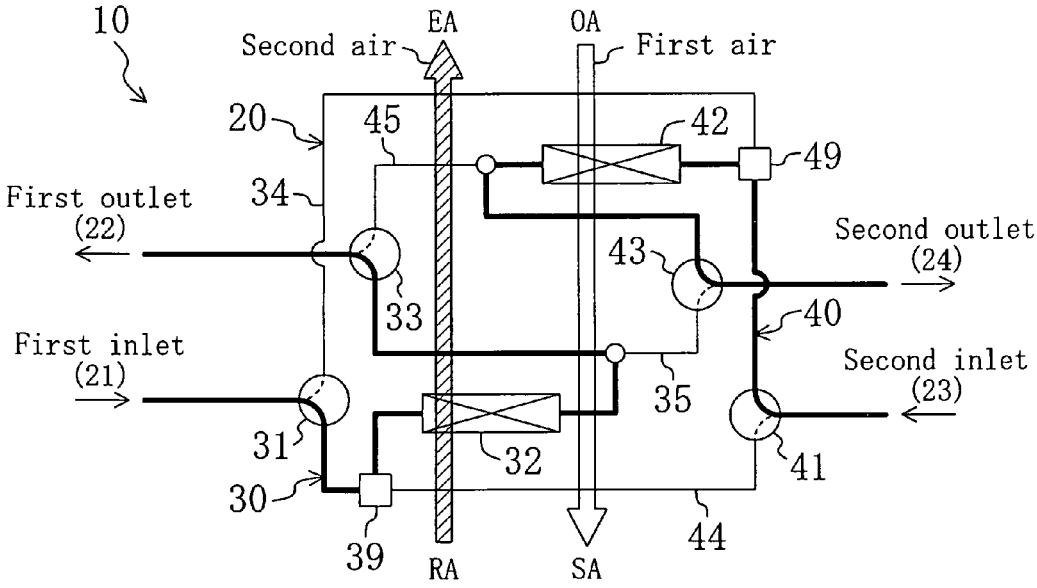
FIG. 25 is a piping diagram to show a piping diagram to show a water circuit of a humidifier according to an embodiment 6.
Figure 26:
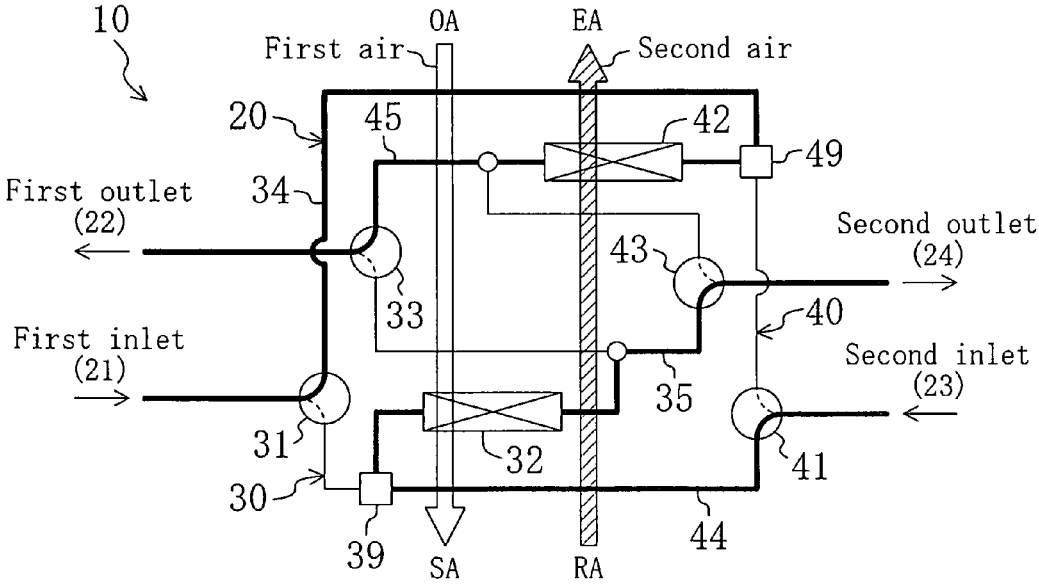
FIG. 26 is a piping diagram to show a piping diagram to show the water circuit of the humidifier according to the embodiment 6.

A humidifier 10 of this embodiment 6, as shown in FIG. 25 and FIG. 26, has two buffer tanks 39, 49 disposed in the water circuit 20 in place of the bypass passages 36 and the bypass three-way valves 37 disposed in the water circuit 20 in the embodiment 1. Here, FIG. 25 and FIG. 26 show the first cycle operation and the second cycle operation at the time of the cooling dehumidifying operation.

The respective buffer tanks 39, 49 are disposed in the first passage 30 and the second passage 40, respectively. The buffer tank 39 of the first passage 30 is disposed upstream of the first adsorption heat exchanger 32 and is connected to the inlet side branch passage 44 of the second passage 40. The buffer tank 49 of the second passage 40 is disposed upstream of the second adsorption heat exchanger 42 and is connected to the inlet side branch passage 34 of the first passage 30. That is, the respective buffer tanks 39, 49 are disposed upstream of the respective outlet side three-way valves 33, 43 and are disposed in passages communicating with the respective inlets 21, 23 at least when the flow of water is switched.

The buffer tanks 39, 49 construct shock-absorbing containers each having a specified volume. Thus, for example, when the water circuit 20 is switched from the first cycle operation to the second cycle operation, if the outlet side three-way valve 33 is normally switched to the second state and the inlet side three-way valve 31 causes a faulty operation in the first passage 30, hot water introduced from the first inlet 21 is stored in the buffer tank 39. On the other hand, also in the second passage 40, for example, if the outlet side three-way valve 43 is normally switched to the second state and the inlet side three-way valve 41 causes a faulty operation, cold water introduced from the second inlet 23 is stored in the buffer tank 49. With this, it is possible to prevent high pressure from being developed by the interception of the flow of water. As a result, it is possible to protect the piping and the like from high pressure.

Further, when all of the three-way valves 31, 33, . . . are normally switched, the flows of cold water and hot water are suddenly switched to cause water hammer, and the buffer tanks 39, 49 can absorb the water hammer. Thus, it is possible to protect the piping and the like from the water hammer when the flows of cold water and hot water are switched.

Here, in this embodiment, the respective buffer tanks 39, 49 are disposed upstream of the first adsorption heat exchanger 32 and the second adsorption heat exchanger 42, respectively. However, the respective buffer tanks 39, 49 may be disposed downstream of the adsorption heat exchangers 32 and 42, respectively, or may be disposed upstream of one of the adsorption heat exchangers 32 and 42 and downstream of the other of the adsorption heat exchangers 32 and 42.

Embodiment 7 of the Invention

Figure 27:
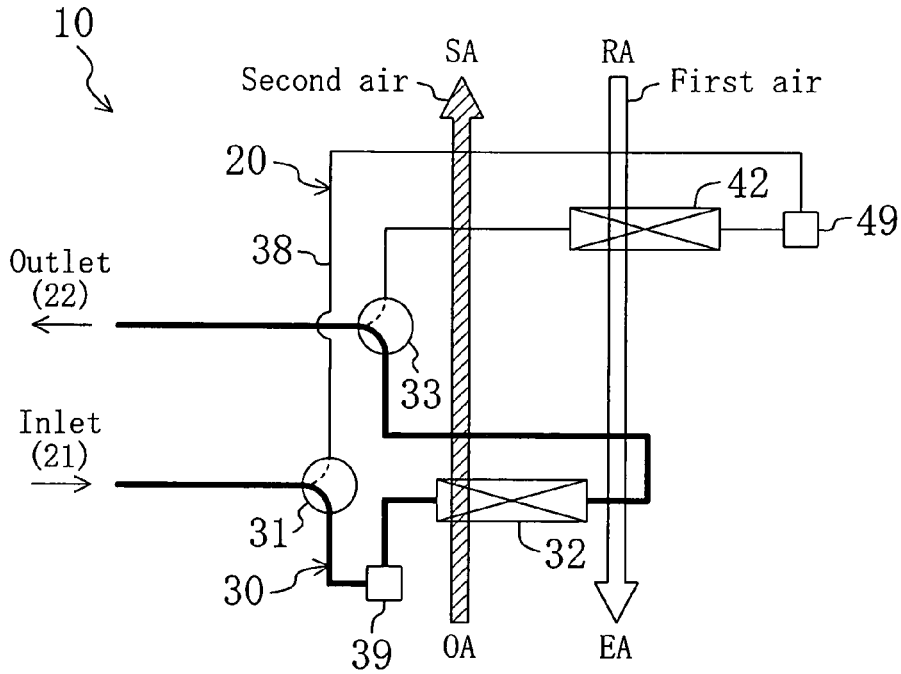
FIG. 27 is a piping diagram to show a piping diagram to show a water circuit of a humidifier according to an embodiment 7.
Figure 28:
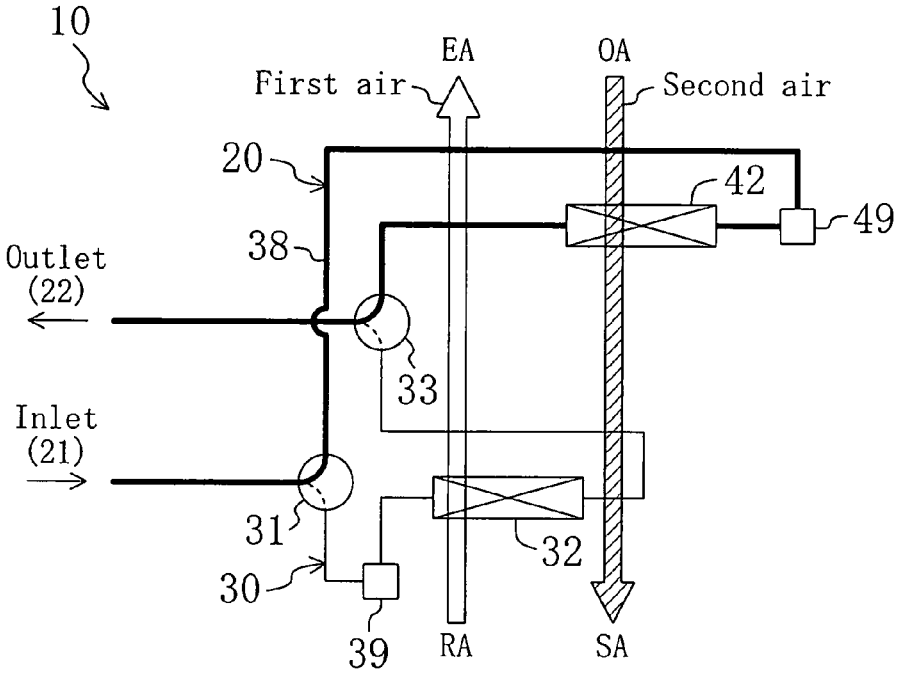
FIG. 28 is a piping diagram to show a piping diagram to show the water circuit of the humidifier according to the embodiment 7.

A humidifier 10 of this embodiment 7, as shown in FIG. 27 and FIG. 28, has two buffer tanks 39, 49 disposed in the water circuit 20 in place of the bypass passage 36 and the bypass three-way valve 37 disposed in the water circuit 20 in the embodiment 4. Here, FIG. 27 and FIG. 28 show the first cycle operation and the second cycle operation at the time of the heating humidifying operation.

The respective buffer tanks 39, 49 are disposed in the first passage 30 and the second passage 40, respectively. The buffer tank 39 of the first passage 30 is disposed between the first adsorption heat exchanger 32 and the inlet side three-way valve 31. The buffer tank 49 of the second passage 40 is disposed upstream of the second adsorption heat exchanger 42. That is, these buffer tanks 39, 49 are disposed upstream of the outlet side three-way valve 33 and are disposed in a passage communicating with the inlet 21 at least when the flow of water is switched.

The buffer tanks 39, 49 construct shock-absorbing containers each having a specified volume. Thus, for example, when the water circuit 20 is switched from the first cycle operation to the second cycle operation, if the outlet side three-way valve 33 is normally switched to the second state and the inlet side three-way valve 31 causes a faulty operation, hot water introduced from the first inlet 21 is stored in the buffer tank 39 of the first passage 30.

Conversely, if the inlet side three-way valve 31 is normally switched to the second state and the outlet side three-way valve 33 causes a faulty operation, hot water introduced from the first inlet 21 is stored in the buffer tank 49 of the second passage 40.

Thus, high pressure developed by the interception of the flow of water is absorbed by the buffer tank 39, which prevents high pressure from being developed in the piping and the like. This can prevent high pressure from being developed by the interception of the flow of water. As a result, it is possible to protect the piping and the like from high pressure.

Further, when all of the three-way valves 31, 33 are normally switched, the flows of cold water and hot water are suddenly switched to cause water hammer, and the buffer tanks 39, 49 can absorb the water hammer. Thus, it is possible to protect the piping and the like from the water hammer when the flows of cold water and hot water are switched.

Here, in this embodiment, the respective buffer tanks 39, 49 are disposed upstream of the first adsorption heat exchanger 32 and the second adsorption heat exchanger 42, respectively. However, the respective buffer tanks 39, 49 may be disposed downstream of the adsorption heat exchangers 32 and 42, respectively, or may be disposed upstream of one of the adsorption heat exchangers 32 and 42 and downstream of the other of the adsorption heat exchangers 32 and 42.

Embodiment 8 of the Invention

Figure 29:
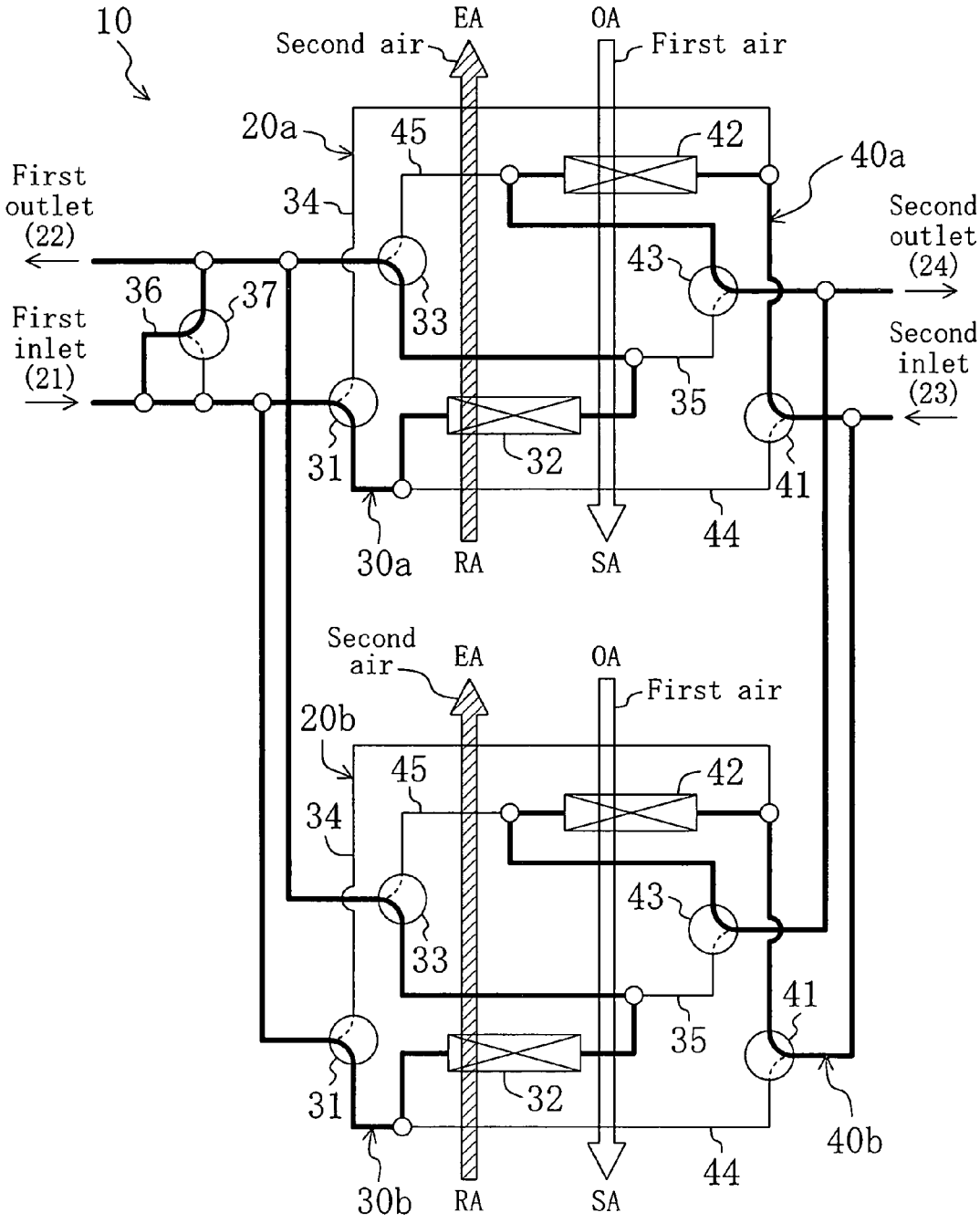
FIG. 29 is a piping diagram to show a piping diagram to show a water circuit of a humidifier according to an embodiment 8.

A humidifier 10 of this embodiment 8, as shown in FIG. 29, is such that connects two water circuits 20 in parallel in the embodiment 1. Further, this embodiment is provided with a pair of inlet 21 and outlet 22 for cold water and a pair of inlet 23 and outlet 24 for hot water, which are in common to two water circuits 20*a*, 20*b*. In other words, hot water introduced from the first inlet 21 and cold water introduced from the second inlet 23 are branched and flowed to the first water circuit 20*a* and the second water circuit 20*b*.

This humidifier 10 has the cooling dehumidifying operation and the heating humidifying operation switched between the first water circuit 20*a* and the second water circuit 20*b*. In other words, the first water circuit 20*a* and the second water circuit 20*b* can switch between the cooling dehumidifying operation and the heating humidifying operation independently of each other. In this case, when the respective water circuit 20*a*, 20*b* are switched to the first cycle operation and the second cycle operation, there is not a possibility that the flows of cold water and hot water are intercepted. The other construction, operation, and effect are the same as those in the embodiment 1.

Embodiment 9 of the Invention

Figure 30:
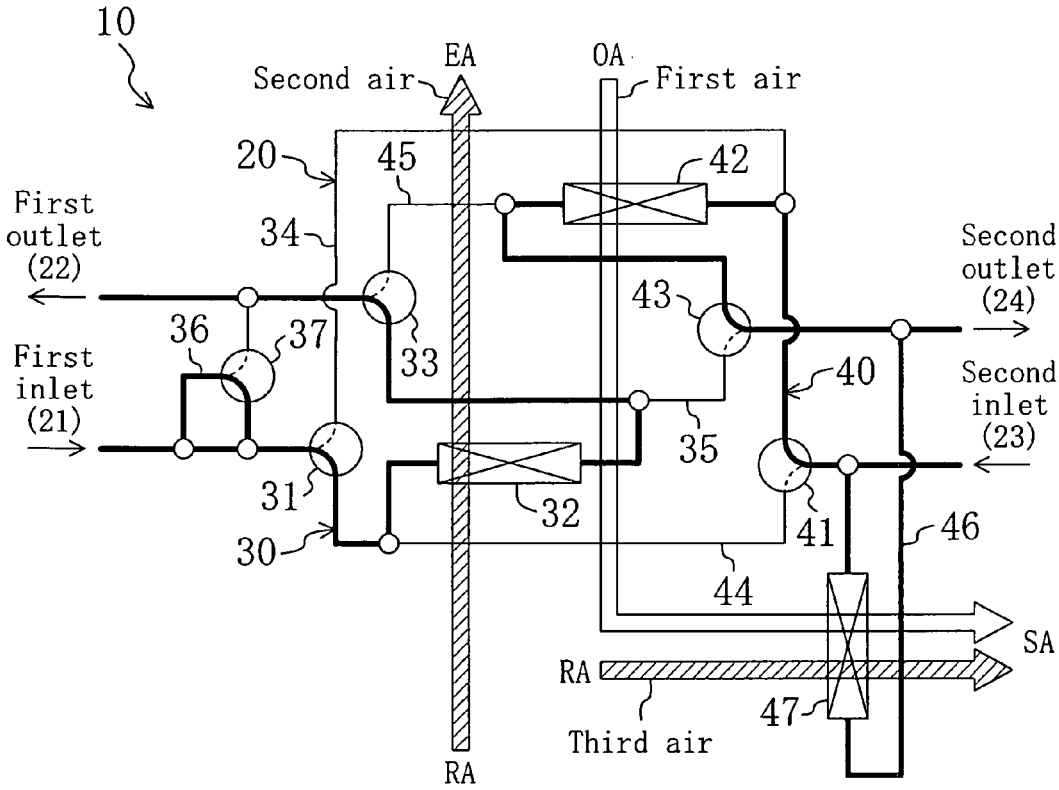
FIG. 30 is a piping diagram to show a piping diagram to show a water circuit of a humidifier according to an embodiment 9.
Figure 31:
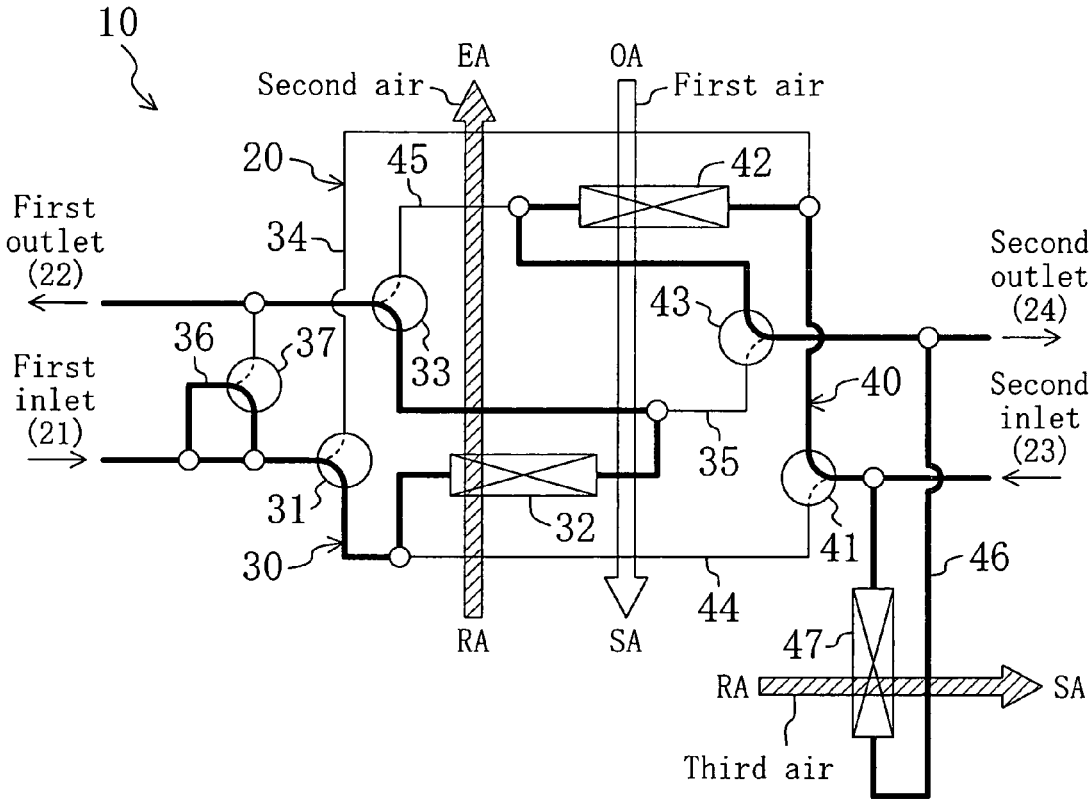
FIG. 31 is a piping diagram to show a piping diagram to show a water circuit of a humidifier according to a modification of the embodiment 9.

A humidifier 10 of this embodiment 9, as shown in FIG. 30, is such that has a third passage 46 added to the water circuit 20 in the embodiment 1, the third passage 46 having an air heat exchanger 47. Specifically, the third passage 46 has the air heat exchanger 47 disposed in the middle and has its one end connected to a portion closer to the second inlet 23 than the inlet side three-way valve 41 in the second passage 40 and has its other end connected to a portion closer to the second outlet 24 than the outlet side three-way valve 43 in the second passage 40. Here, FIG. 30 shows an operation at the time of performing the cooling dehumidifying operation.

The air heat exchanger 47 is a sensible-heat heat exchanger constructed of a so-called cross-fin type fin-and-tube heat exchanger. When the cooling dehumidifying operation is performed, cold water flows through the air heat exchanger 47 and when the heating humidifying operation is performed, hot water flows through the air heat exchanger 47. Further, the air heat exchanger 47 is constructed in such a way that when the cooling dehumidifying operation is performed, the dehumidified first air flows and the room air RA flows as third air, whereas that when the heating humidifying operation is performed, the humidified second air flows and the room air RA flows as third air. Here, when the cooling dehumidifying operation and the heating humidifying operation are performed, the switching of the water circuit 20 to the first cycle operation and the second cycle operation is performed in the same way as in the embodiment 1.

In this embodiment, when the cooling dehumidifying operation is performed, the first air dehumidified by the first adsorption heat exchanger 32 or the second adsorption heat exchanger 42 is cooled by cold water in the air heat exchanger 47 and is supplied into the room and the third air is cooled by the cold water in the air heat exchanger 47 and is supplied into the room. Thus, this can increase the cooling capacity. Further, when the healing humidifying operation is performed, the second air humidified by the first adsorption heat exchanger 32 or the second adsorption heat exchanger 42 is heated by hot water in the air heat exchanger 47 and is supplied into the room and the third air is heated by the hot water in the air heat exchanger 47 and is supplied into the room. Thus, this can increase the heating capacity. The other construction, operation, and effect are the same as those in the embodiment 1.

Here, in this embodiment, when the cooling dehumidifying operation is performed, the second air and the third air are taken in separately, and when the heating humidifying operation is performed, the first air and the third air are taken in separately. However, part of the taken-in second air or the taken-in first air may be flowed as the third air to the air heat exchanger 47. Further, a third passage 46 having the air heat exchanger 47 in this embodiment can be applied also to the water circuit 20 in the embodiment 2.

Modification of Embodiment 9

While the dehumidified first air or the humidified second air is flowed through the air heat exchanger 47 in the embodiment 9, the dehumidified first air or the humidified second air is supplied into the room in this modification without being subjected to any operation. In other words, when the cooling dehumidifying operation is performed, the dehumidified first air is supplied into the room without being subjected to any operation and the third air cooled by the air heat exchanger 47 is supplied into the room. Further, when the heating humidifying operation is performed, the humidified second air is supplied into the room without being subjected to any operation and the third air heated by the air heat exchanger 47 is supplied into the room. Thus, this can increase the cooling capacity and the heating capacity. The other construction, operation, and effect are the same as those in the embodiment 1. Here, the third passage 46 having the air heat exchanger 47 in this modification can be applied also to the water circuit 20 in the second embodiment 2.

Embodiment 10 of the Invention

Figure 32:
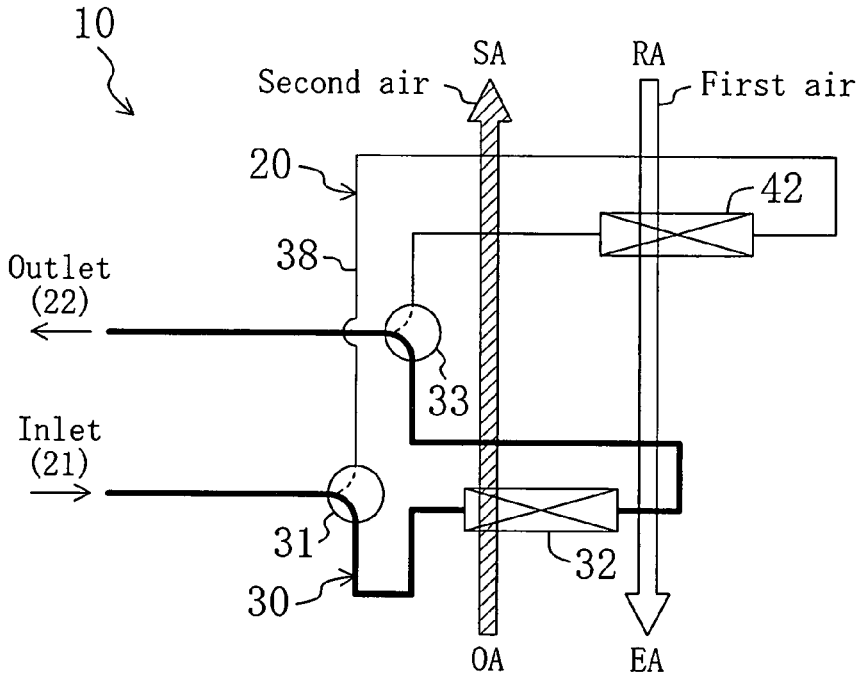
FIG. 32 is a piping diagram to show a piping diagram to show a water circuit of a humidifier according to an embodiment 10.
Figure 33:
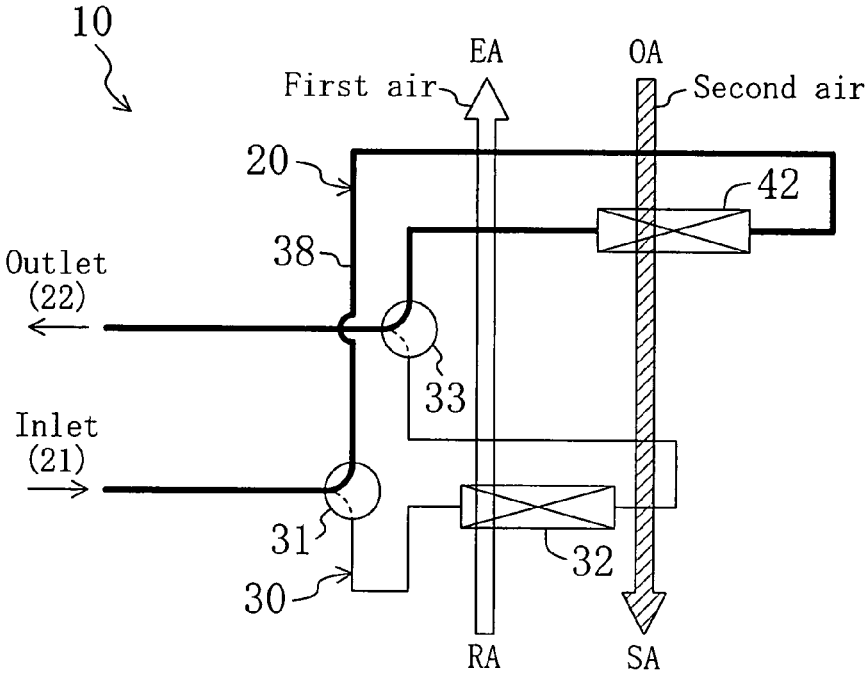
FIG. 33 is a piping diagram to show a piping diagram to show the water circuit of the humidifier according to the embodiment 10.

A humidifier 10 of this embodiment 10, as shown in FIG. 32 and FIG. 33, has the water circuit 20 constructed of a circuit in which only hot water flows. Specifically, the water circuit 20 has one inlet 21 and one outlet 22 for hot water. The water circuit 20 has the same first passage 30 as in the embodiment 1 and a second passage 38 the construction of which is changed from that of the embodiment 1. The first passage 30 connects the inlet 21 to the outlet 22 and has the inlet side three-way valve 31, the first adsorption heat exchanger 32, and the outlet side three-way valve 33 disposed in the order closer to the inlet 21. The second passage 38 has the second adsorption heat exchanger 42 disposed in the middle and is connected to the inlet side three-way valve 31 and the outlet side three-way valve 33.

The water circuit 20 is constructed in such a way that the first cycle operation (state shown in FIG. 32) in which hot water introduced from the inlet 21 flows through the first adsorption heat exchanger 32 and then flows to the outlet 22 and the second cycle operation (state shown in FIG. 33) in which hot water introduced from the inlet 21 flows to the second passage 38 and then flows through the second adsorption heat exchanger 42 and then flows to the outlet 22 are alternately performed by switching the inlet side three-way valve 31 and the outlet side three-way valve 33. Further, this humidifier 10 can switch between the cooling dehumidifying operation and the heating humidifying operation. Here, FIG. 32 and FIG. 33 show the heating humidifying operation.

For example, when the heating humidifying operation is performed, the flow of air is switched in such a way that the second air humidified by the first adsorption heat exchanger 32 or the second adsorption heat exchanger 42 through which hot water flows is supplied into the room (see FIG. 32 and FIG. 33). Further, when the cooling dehumidifying operation is performed, although not shown in the drawing, the flow of air is switched in such a way that the first air dehumidified by the second adsorption heat exchanger 42 or the first adsorption heat exchanger 32 through which hot water does not flow is supplied into the room.

Further, the water circuit 20 is constructed in such a way as to switch the flow of air after a specified time passes from when the inlet side three-way valve 31 and the outlet side three-way valve 33 are switched, in other words, from when the flow of hot water is switched. Thus, the first adsorption heat exchanger 32 or the second adsorption heat exchanger 42 that has dehumidified the first air is previously heated during the specified time, so after the flow of air is switched, the second air is immediately heated and is supplied into the room. With this, the comfort in the room can be enhanced.

Modification of Embodiment 10

Figure 34:
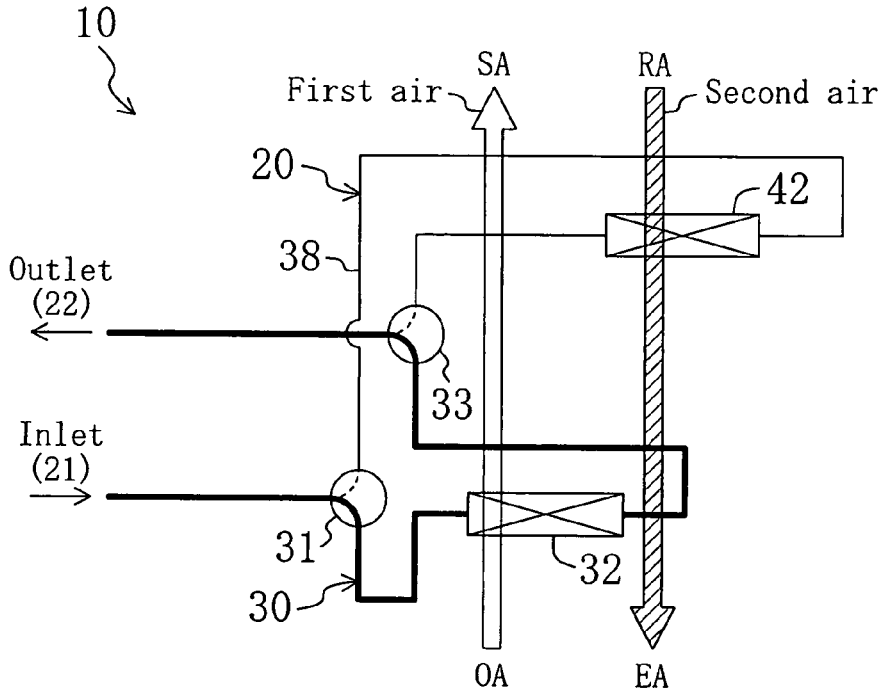
FIG. 34 is a piping diagram to show a piping diagram to show a water circuit of a humidifier according to a modification of the embodiment 10.
Figure 35:
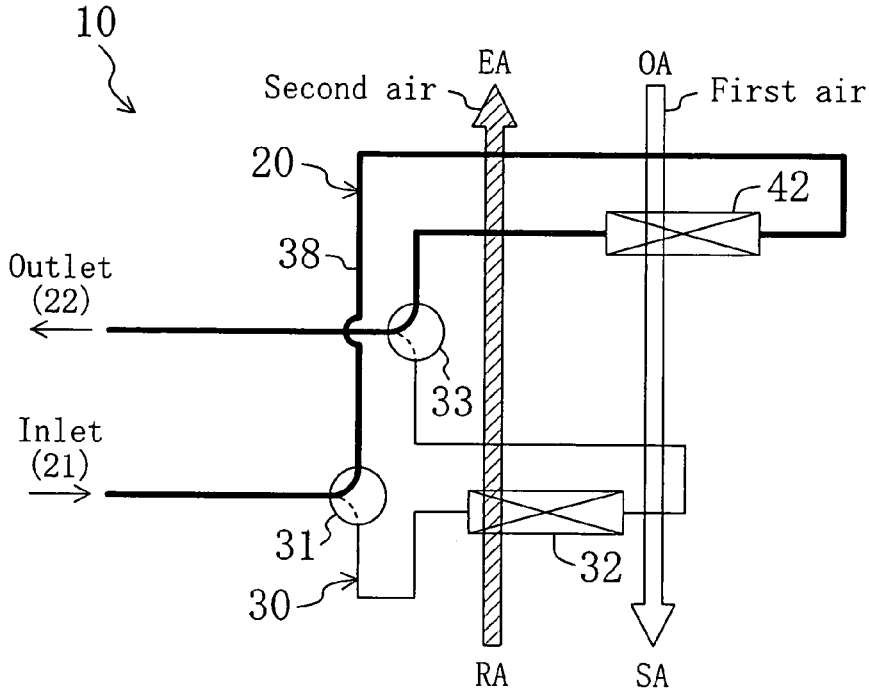
FIG. 35 is a piping diagram to show a piping diagram to show the water circuit of the humidifier according to the modification of the embodiment 10.

While the water circuit 20 in the embodiment 10 is constructed of a circuit in which only hot water flows, this modification has the water circuit 20 constructed of a circuit in which only cold water flows, as shown in FIG. 34 and FIG. 35. In other words, the water circuit 20 in this modification is constructed in such as way that the first cycle operation (state shown in FIG. 34) in which cold water introduced from the inlet 21 flows through the first adsorption heat exchanger 32 and then flows to the outlet 22 and the second cycle operation (state shown in FIG. 35) in which the cold water introduced from the inlet 21 flows to the second passage 38 and then flows through the second adsorption heat exchanger 42 and then flows to the outlet 22 are alternately performed by the switching the inlet side three-way valve 31 and the outlet side three-way valve 33. Further, the humidifier 10 of this modification can switch between the cooling dehumidifying operation and the heating humidifying operation. Here, FIG. 34 and FIG. 35 show the cooling dehumidifying operation.

For example, when the cooling dehumidifying operation is performed, the flow of air is switched in such a way that the first air dehumidified by the first adsorption heat exchanger 32 or the second adsorption heat exchanger 42 through which cold water flows is supplied into the room (see FIG. 34 and FIG. 35). Further, when the heating humidifying operation is performed, although not shown in the drawing, the flow of air is switched in such a way that the second air humidified by the first adsorption heat exchanger 32 or the second adsorption heat exchanger 42 through which the cold water does not flow is supplied into the room.

The water circuit 20 is constructed in such a way as to switch the flow of air after a specified time passes from when the inlet side three-way valve 31 and the outlet side three-way valve 33 are switched, in other words, from when the flow of cold water is switched. Thus, the first adsorption heat exchanger 32 or the second adsorption heat exchanger 42 that has humidified the second air is previously cooled during the specified time, so after the flow of air is switched, the first air is immediately cooled and is supplied into the room. With this, the comfort in the room can be enhanced.

Embodiment 11 of the Invention

Figure 36:
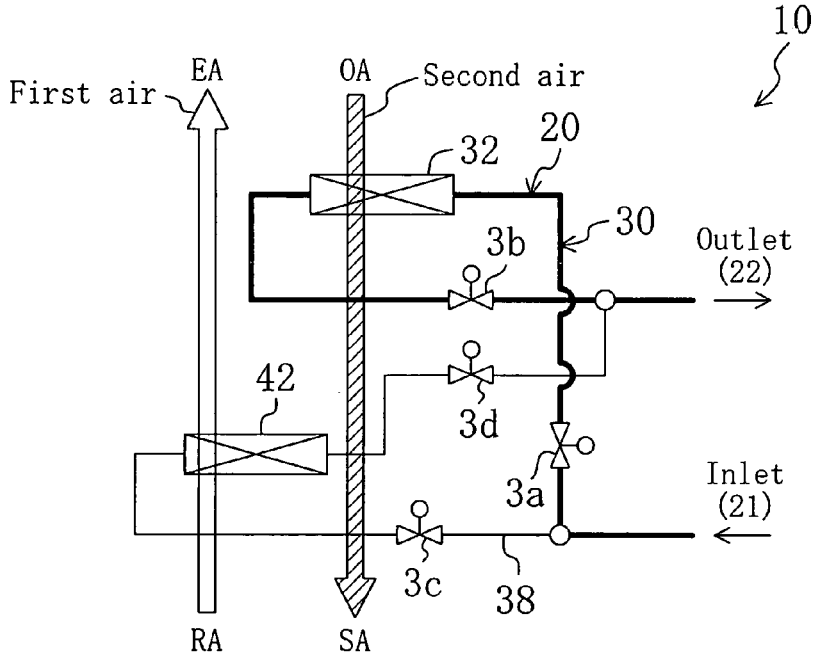
FIG. 36 is a piping diagram to show a piping diagram to show a water circuit of a humidifier according to an embodiment 11.
Figure 37:
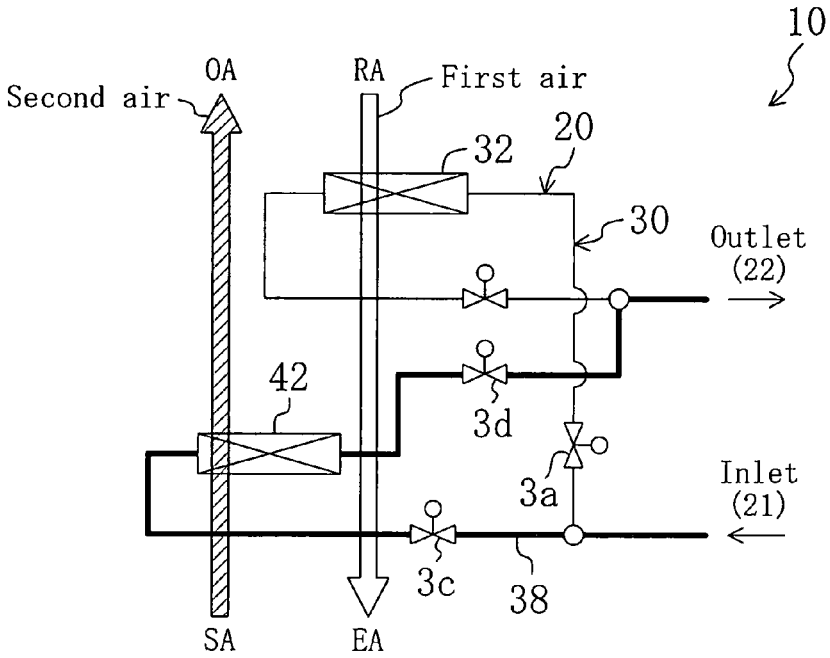
FIG. 37 is a piping diagram to show a piping diagram to show the water circuit of the humidifier according to the embodiment 11.

A humidifier 10 of this embodiment 11, as shown in FIG. 36 and FIG. 37, uses a plurality of two-way valves in place of the inlet side three-way valve 31 and the outlet side three-way valve 33 in the water circuit 20 in the embodiment 10. In other words, the first passage 30 has a first two-way valve 3*a* and a second two-way valve 3*b* disposed respectively upstream and downstream of the first adsorption heat exchanger 32. Further, a second passage 38 has a third two-way valve 3*c* and a fourth two-way valve 3*d* disposed respectively upstream and downstream of the second adsorption heat exchanger 42.

The water circuit 20 is switched between a state in which the first two-way valve 3*a* and the second two-way valve 3*b* are set to the open state and in which the third two-way valve 3*c* and the fourth two-way valve 3*d* are set to the closed state and a state in which the first two-way valve 3*a* and the second two-way valve 3*b* are set to the closed state and in which the third two-way valve 3*c* and the fourth two-way valve 3*d* are set to the open state. In other words, the water circuit 20 is constructed in such as way that the first cycle operation (state shown in FIG. 36) in which hot water introduced from the inlet 21 flows through the first adsorption heat exchanger 32 and then flows to the outlet 22 and the second cycle operation (state shown in FIG. 37) in which the hot water introduced from the inlet 21 flows to the second passage 38 and then flows through the second adsorption heat exchanger 42 and then flows to the outlet 22 are alternately performed. Further, this humidifier 10 can switch between the cooling dehumidifying operation and the heating humidifying operation. Here, FIG. 36 and FIG. 37 show the heating humidifying operation.

Also in this embodiment, the water circuit 20 is constructed in such a way as to switch the flow of air after a specified time passes from when the flow of hot water is switched. Thus, after the flow of air is switched, the second air is immediately heated and is supplied into the room. With this, the comfort in the room can be enhanced. Here, when the water circuit 20 is constructed of a circuit in which not hot water but only cold water flows, the water circuit 20 is constructed in such a way as to switch the flow of air after a specified time passes from when the flow of cold water is switched.

Other Embodiments

For example, in the water circuit 20 of the embodiment 1 or the embodiment 3, just as with the modification of the embodiment 4, the bypass passage 36 may be connected to any one of the upstream side or the downstream side of the first adsorption heat exchanger 32 and any one of the upstream side or the downstream side of the second adsorption heat exchanger 42. In this case, the bypass three-way valve 37 is constructed of a two-way valve.

Here, the above-mentioned embodiments are essentially preferable examples and it is not intended to limit the present invention, its applications, or the range of its use to the embodiments.

INDUSTRIAL APPLICABILITY

As described above, the present invention is useful as a humidifier provided with a water circuit having an adsorption heat exchanger.

The invention claimed is:

1. A humidifier, comprising:

a water circuit which has a first heat exchanger and a second heat exchanger connected thereto and through which waters of cold water and hot water flow, the first heat exchanger and the second heat exchanger each having an adsorbent and adsorbing moisture in air and desorbing the moisture to discharge the moisture into the air, wherein:

the water circuit switches flow of the water between a first flow state, in which the hot water introduced from a first inlet flows through the first heat exchanger and flows to a first outlet and in which the cold water introduced from a second inlet flows through the second heat exchanger and flows to a second outlet, and a second flow state, in which the hot water introduced from the first inlet flows through the second heat exchanger and flows to the first outlet and in which the cold water introduced from the second inlet flows through the first heat exchanger and flows to the second outlet, and adsorbs and desorbs the moisture alternately by the first heat exchanger and the second heat exchanger; and the water circuit has bypass passages for connecting the respective inlets to the respective outlets at a time of switching the flow of the water.

2. The humidifier according to claim 1, wherein the bypass passage has a bypass shutoff valve and is connected to either of an upstream side and a downstream side of the first heat exchanger and to either of an upstream side and a downstream side of the second heat exchanger.

3. The humidifier according to claim 1, wherein:

the water circuit has hot-water inlet side switching means, hot-water outlet side switching means, cold-water inlet side switching means, and cold-water outlet side switching means, the switching means being used for switching the flow of the water between the first flow state and the second flow state; and the bypass passage has at least either of a hot-water bypass passage and a cold-water bypass passage, the hot-water bypass passage having a bypass shutoff valve and being connected to an upstream side of the hot-water inlet side switching means and to a downstream side of the hot-water outlet side switching means, and the cold-water bypass passage having a bypass shutoff valve and being connected to an upstream side of the cold-water inlet side switching means and to a downstream side of the cold-water outlet side switching means.

4. The humidifier according to claim 1, wherein:

the water circuit has hot-water inlet side switching means, hot-water outlet side switching means, cold-water inlet side switching means, and cold-water outlet side switching means, the switching means being used for switching the flow of the water between the first flow state and the second flow state; and at the time of switching the flow of the water, the respective outlet side switching means are switched and then the respective inlet side switching means are switched.

5. The humidifier according to claim 4, wherein when a humidifying operation is performed, at the time of switching the flow of the water, the cold-water outlet side switching means is switched and then the hot-water outlet side switching means is switched.

6. The humidifier according to claim 4, wherein when a dehumidifying operation is performed, at the time of switching the flow of the water, the hot-water outlet side switching means is switched and then the cold-water outlet side switching means is switched.

7. The humidifier according to claim 1, wherein:

the water circuit switches the flow of the water and flow of air in such a way that in the first flow state, first air is dehumidified by the second heat exchanger and second air is humidified by the first heat exchanger and in such a way that in the second flow state, the first air is dehumidified by the first heat exchanger and the second air is humidified by the second heat exchanger; and the flow of air is switched after a specified time passes from when flow of at least either of the cold water and the hot water is switched.

8. The humidifier according to claim 7, wherein when a dehumidifying operation for supplying the dehumidified first air to a use side is performed, the water circuit is switched to an intermediate state in which the flow of the hot water to the first heat exchanger and the second heat exchanger is intercepted for a specified time that passes from when the flow of the cold water is switched until the flow of air is switched.

9. The humidifier according to claim 7, wherein when a humidifying operation for supplying the humidified second air to a use side is performed, the water circuit is switched to an intermediate state in which the flow of the cold water to the first heat exchanger and the second heat exchanger is intercepted for a specified time that passes from when the flow of the hot water is switched until the flow of air is switched.

10. The humidifier according to claim 8, wherein the water circuit has a bypass passage through which the hot water flows to bypass the first heat exchanger and the second heat exchanger in the intermediate state.

11. The humidifier according to claim 9, wherein the water circuit has a bypass passage through which the cold water flows to bypass the first heat exchanger and the second heat exchanger in the intermediate state.

* * * * *